United States Patent [19]

Gero

[11] Patent Number: 5,014,906

[45] Date of Patent: May 14, 1991

[54] MULTIPLE PURPOSE DISPENSING PACKAGE AND BLANK

[76] Inventor: Gabriel Gero, 306 Merry Mount St., Staten Island, N.Y. 10314

[21] Appl. No.: 254,271

[22] Filed: Oct. 5, 1988

[51] Int. Cl.[5] ..... B65D 5/00

[52] U.S. Cl. ..... 229/123; 206/249; 206/255; 206/273; 206/817

[58] Field of Search ..... 206/249, 255, 261, 263, 206/271, 273, 555, 556, 631.1, 817; 229/123

[56] References Cited

U.S. PATENT DOCUMENTS

| | | | |
|---|---|---|---|
| 1,186,624 | 6/1916 | Vanderveer | 206/249 |
| 2,944,555 | 7/1960 | Peel et al. | 206/273 |
| 2,958,418 | 11/1960 | O'Gorman | 206/273 |
| 3,749,234 | 7/1973 | Gero | 206/273 |
| 4,588,081 | 5/1986 | Newsome et al. | 206/263 |
| 4,732,276 | 3/1988 | Knecht | 206/273 |
| 4,742,955 | 5/1988 | Facke et al. | 206/273 |

FOREIGN PATENT DOCUMENTS

| | | | |
|---|---|---|---|
| 766586 | 9/1967 | Canada | 206/249 |

*Primary Examiner*—David T. Fidei

*Attorney, Agent, or Firm*—Lackenbach Siegel Marzullo & Aronson

[57] ABSTRACT

A multiple-purpose dispensing package having inner and outer shells wherein the inner shell is movable within the outer shell between fully closed and fully open positions. The inner shell is integrally pivotably connected to the outer shell. The package includes a snap-lock member. The inner and the outer shell are made from a single blank. Optionally, the inner shell, the outer shell, and the snap-lock member can be made from a single blank. The inner shell and the outer shell are connected along a hinge line integral with the single blank.

10 Claims, 11 Drawing Sheets

FIG. 1
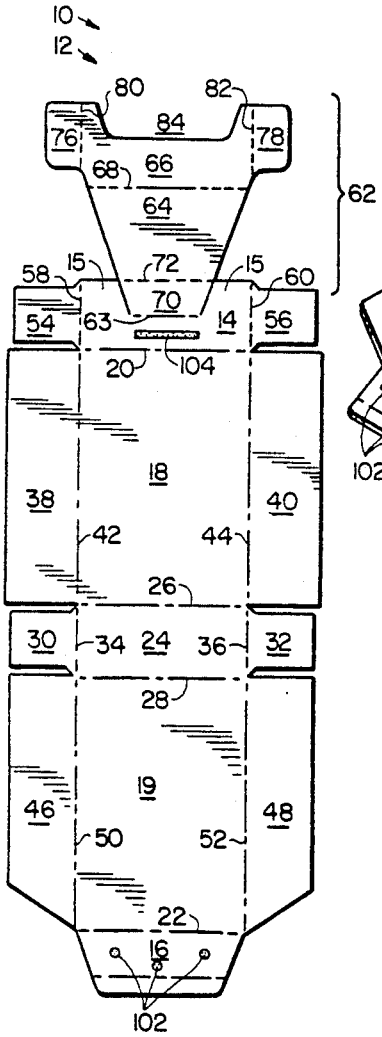
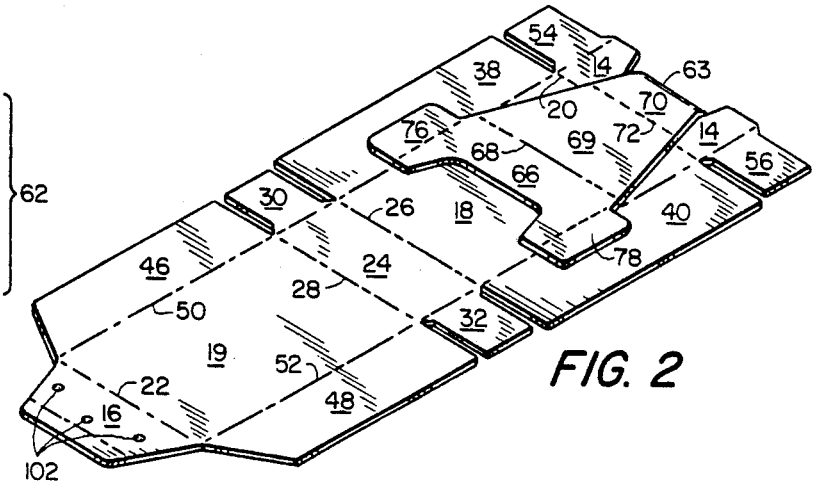
FIG. 2
FIG. 3
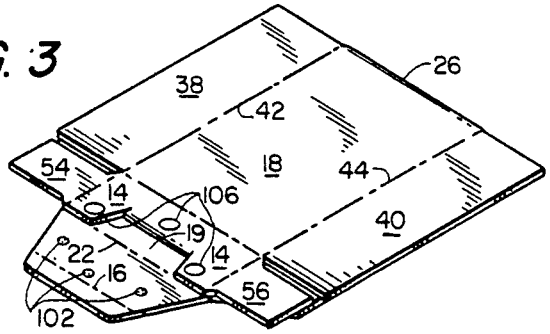
FIG. 4
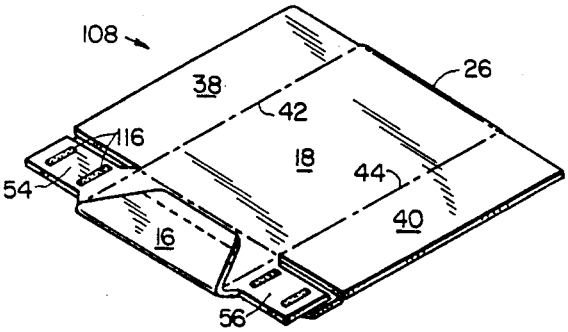
FIG. 5
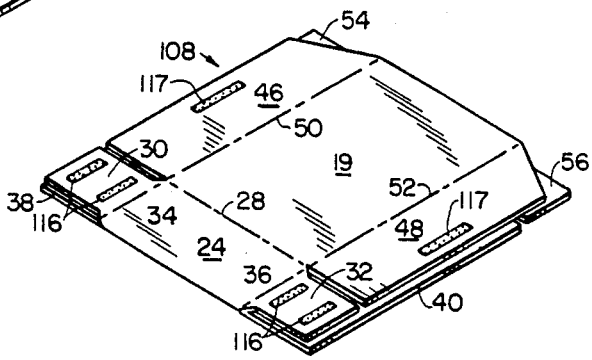

FIG. 26
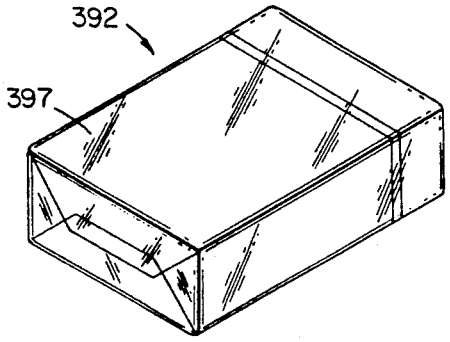
FIG. 27
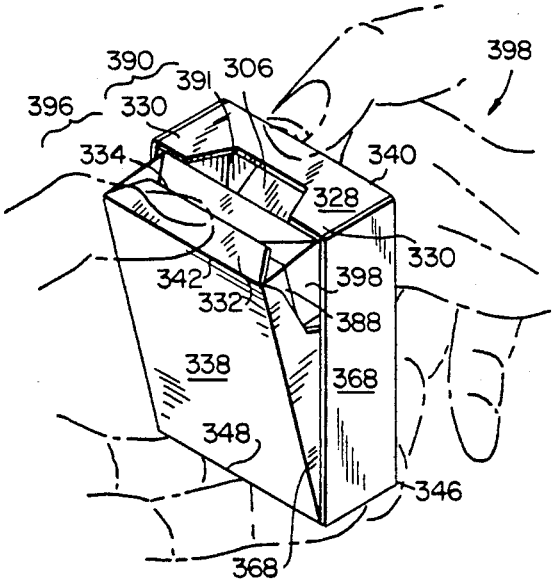
FIG. 28
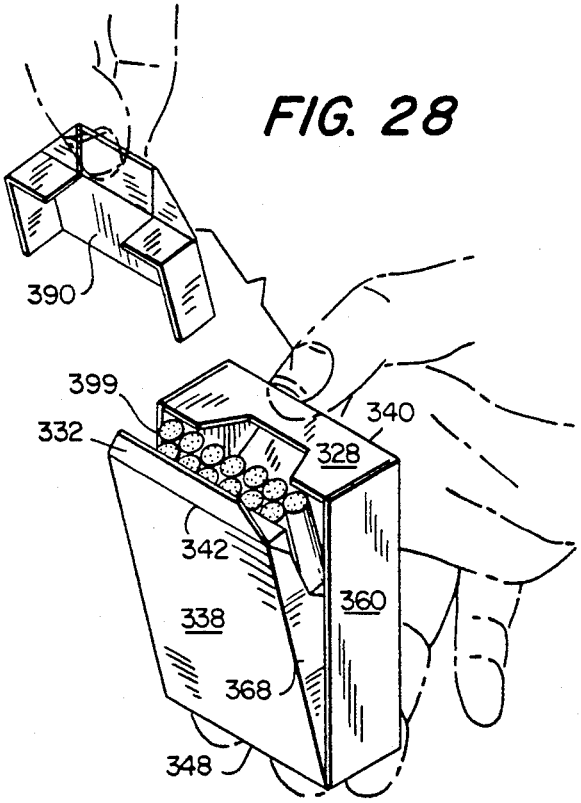
FIG. 30
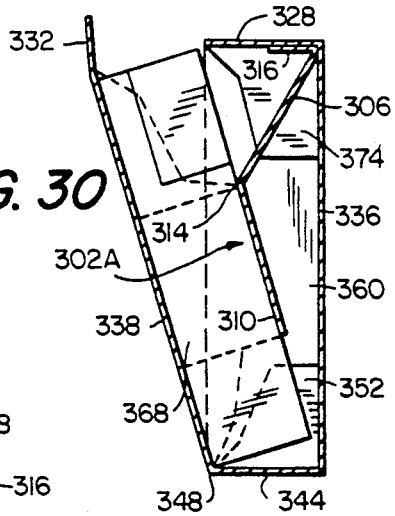
FIG. 25
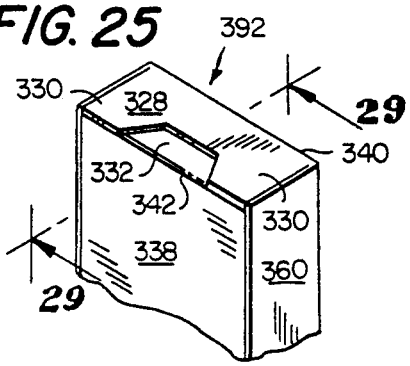
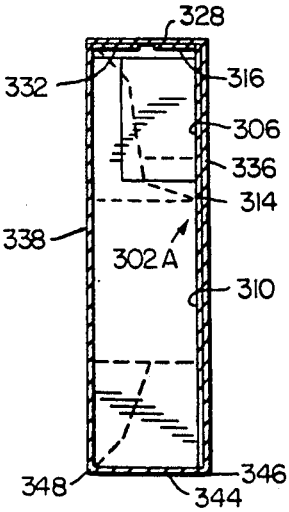
FIG. 29

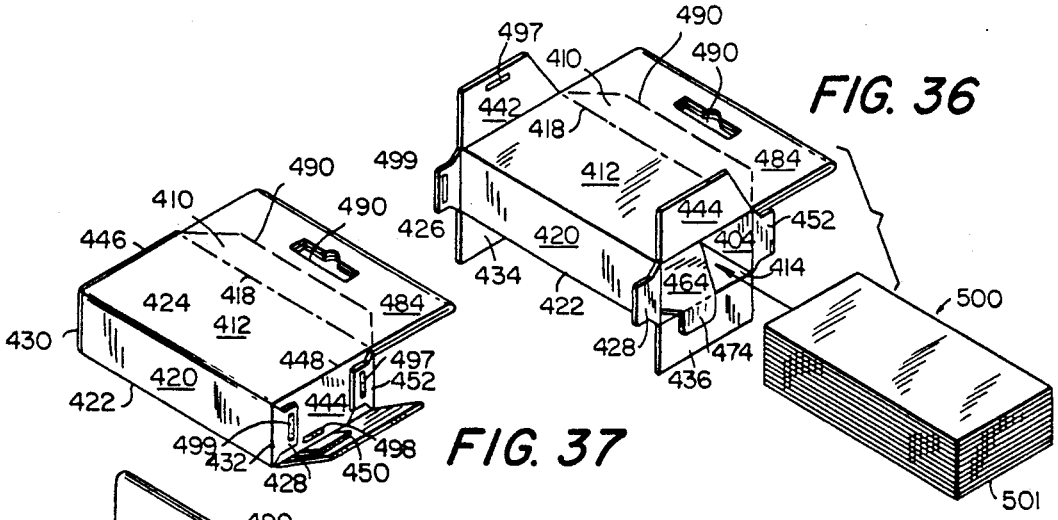
FIG. 36
FIG. 37
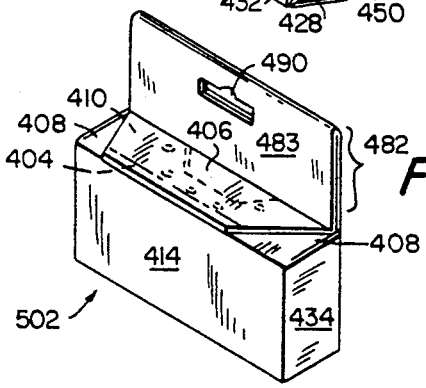
FIG. 38
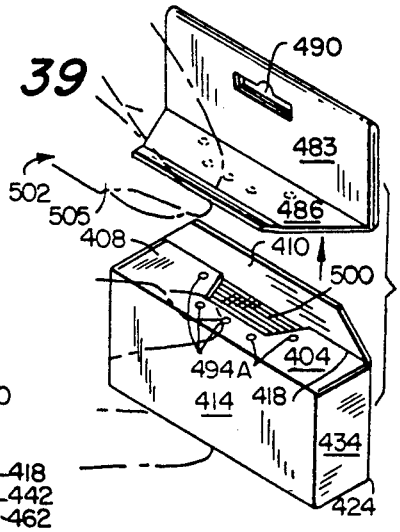
FIG. 39
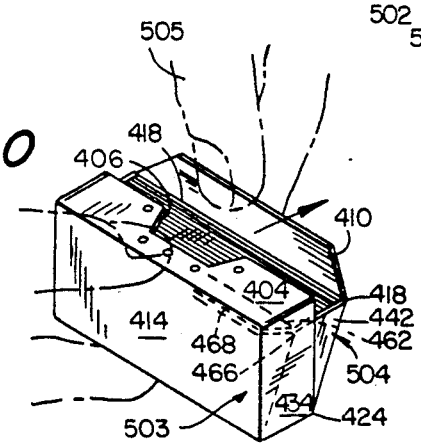
FIG. 40
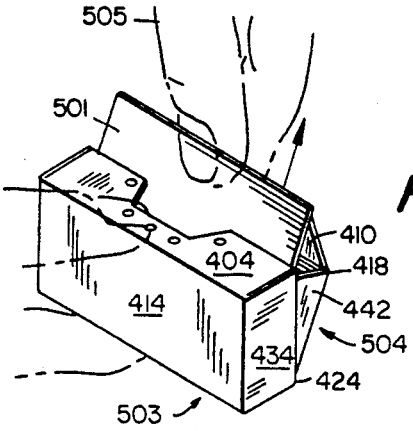
FIG. 41
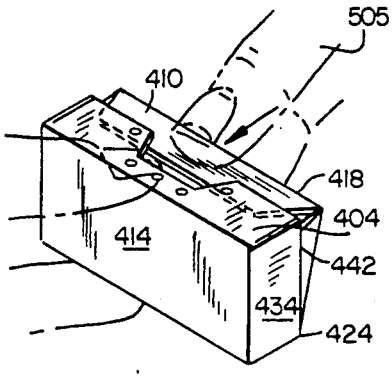
FIG. 42

MULTIPLE PURPOSE DISPENSING PACKAGE AND BLANK

CROSS-REFERENCE TO RELATED APPLICATIONS

This application is related to my earlier patent applications, namely, U.S. Pat. No. 4,172,520, granted Oct. 30, 1979; U.S. Pat. No. 3,583,625, granted June 8, 1971; U.S. Pat. No. 3,749,234, granted July 31, 1973.

BACKGROUND OF THE INVENTION

This invention relates to dispensing packages and blanks for making the same and more particularly to multiple purpose dispensing packages and blanks for dispensing longitudinal products such as cigarettes and packets of dried soup and also large particulate products such as macaroni.

My prior dispensing package constructions had an inner shell swingable relative to an outer shell, the inner shell being held in either an open or a closed position by a snap-lock, or toggle, member. The dispensing packages, which were directed towards the dispensing of cigarettes and the like, were narrow front-opening packages, which did not fully display the contents of the packages when in the open position. Also, the openings from which the products were dispensed were not capable of being of being self-sealed after dispensation. My prior dispensing package constructions were suitable primarily for cigarettes and the like, not also for large particulate products. In addition, my prior patents, which taught inner shells swingable in an outer shell between closed and open positions, were hinged about a connecting line that was adhesively secured between the inner and the outer shells rather than being integrally secured.

There are many other package structures known in the art, but these have numerous disadvantages, among them being the use of multiple blanks, not being self-sealing after opening, and having narrow front openings rather than wide front openings, with the result that wide-bodied products such as soup packets cannot be used. Another disadvantage of other unitary blank package structures having mutually rotatable inner and outer shells is the absence of an integrally connected hinge line as mentioned above. The disadvantages mentioned are often combined. The references cited during the prosecution of my U.S. Pat. No. 4,172,520 are as follows: U.S. Pat. Nos. 2,071,856; 2,339,656; 2,533,255; 2,958,418; 3,037,678; 3,052,398; 3,282,465; 3,583,625; 3,749,234; 3,863,760; and 3,881,599. References cited during the prosecution of my U.S. Pat. No. 3,749,234 are as follows: U.S. Pat. Nos. 3,058,398; 2,148,319; 3,127,083; 1,735,323; 2,929,542; and 3,107,008; and Canadian Pat. No. 766,586. References cited during the prosecution of my U.S. Pat. No. 3,583,625 are as follows: U.S. Pat. Nos. 2,002,364; 2,201,333; 2,901,097; 3,052,398; 3,206,100; 3,207,416; and 3,241,737; and French Pat. No. 1,208,736. Other examples of dispensing packages are shown in U.S. Pat. Nos. 1,394,591; 3,037,678; and 3,881,599; and in British Pat. No. 979,355; and in Swiss Pat. No. 339,117.

SUMMARY OF THE INVENTION

Accordingly, it is an object of this invention to provide a dispenser package for longitudinal products using a unitary blank to make a wide front-opening package for dispensing longitudinal products.

It is another object of this invention to provide a dispenser package for longitudinal objects that is made from a unitary blank, which is more economically feasible than prior two-piece blanks.

It is another object of this invention to provide a dispenser package for longitudinal objects that is made from a unitary blank that is adaptable to existing commercial machinery.

It is another object of this invention to provide a dispenser package for large particulate products having a narrow front-opening for large particulate products such as macaroni that is self-sealing after opening and which is made from a unitary blank.

It is another object of this invention to provide a dispenser package that displays the entire contents of the package when it is in the open position.

It is another object of this invention to provide a blank for a dispenser package having an inner shell swingable between open and closed positions relative to an outer shell, the inner shell being swingable about a hinge line which is integrally joined to the blank.

In accordance with these and other objects there is provided a pre-glued starting blank which is folded, glued, erected, filled, and sealed by conventional packaging equipment resulting in an easy opening, tamper-proof or tamper-evident dispensing package for a diversified range of products. A multiple-purpose dispensing package having inner and outer shells wherein the inner shell is movable within the outer shell between fully closed and fully open positions. The inner shell is integrally pivotably connected to the outer shell. The package includes a snap-lock member. The inner and the outer shell are made from a single blank. Optionally, the inner shell, the outer shell, and the snap-lock member can be made from a single blank. The inner shell and the outer shell are connected along a hinge line integral with the single blank. Six embodiments are illustrated.

A first embodiment sets forth a unitary blank for a dispensing package having an inner shell and an outer shell and a toggle snap-lock. A wide wall panel integral with the package is swingable from the package.

A second embodiment sets forth a unitary blank for a dispensing package having an inner shell and an outer shell and a toggle snap-lock. A wide wall panel integral with the package is swingable from the package.

A third embodiment sets forth a two-piece blank for a dispensing package having an inner shell and an outer shell and a toggle snap-lock.

A fourth embodiment sets forth a unitary blank for a dispensing package having an inner shell and an outer shell and a toggle snap-lock. A wide wall panel integral with the package is swingable from the package.

A fifth embodiment sets forth a unitary blank having an inner shell and an outer shell and a double toggle snap-lock. A narrow wall panel integral with the package is swingable from the package.

A sixth embodiment sets forth a unitary blank having a narrow swingable pour spout integral with the package.

The present invention will be better understood and the objects and important features, other than these specifically enumerated above, will become apparent when consideration is given to the following details and descriptions, which when taken in conjunction with the annexed drawings, describes, discloses, illustrates, and shows preferred embodiments or modifications of the present invention and what is presently considered and believed to be the best mode of practice in the principles thereof. Other embodiments or modifications may be suggested to those having the benefit of the teaching herein, and such other embodiments or modifications are intended to be reserved especially as they fall within the scope and spirit of the subjoined claims.

BRIEF DESCRIPTION OF THE DRAWINGS

FIG. 1 is a plan view of a unitary starting blank having an integral snap lock for a wide-opening dispensing package in accordance with the teachings of the present invention;

FIG. 2 is a perspective view of the blank shown in FIG. 1 after the first step of folding over and securing an adhesive area by a manufacturer for assembling a collapsed package for shipment to a customer;

FIG. 3 is a perspective view of the blank shown in FIG. 1 showing a second fold over by the manufacturer after the second step of folding over shown in FIG. 2;

FIG. 4 is a perspective view of the package showing a third fold over into a final collapsed form of the package by the manufacturer after the second step of folding shown in FIG. 3; FIG. 4 also shows adhesive to be applied later by the customer in the process of making the final package;

FIG. 5 is a perspective view of the reverse side of the final collapsed form of the package shown in FIG. 4; FIG. 5 also shows the remainder of the adhesive to be applied later by the customer in the process of making the final package;

FIG. 6 also shows the step of filling the erected package with a bundle of narrow elongated items;

FIG. 25 is a partial perspective view of the assembled package after the steps shown in FIG. 24;

FIG. 26 is a perspective view of the assembled package of the assembled dispensing package after placing conventional plastic overlap over the assembled package;

FIG. 27 is a perspective view of a consumer opening the assembled package illustrated in FIG. 26;

FIG. 28 is a perspective view of the consumer removing a foil top from the bundle of cigarettes in the assembled package shown in FIG. 27;

FIG. 29 is a sectional view taken through plane 29—29 in FIG. 25;

FIG. 30 is a sectional view of the opened dispensing package showing the toggle snap-lock member holding the package in the open position;

FIG. 34 also shows adhesive to be applied later by the customer in the process of making the final package; FIG. 35 also shows the remainder of the adhesive to be applied later by the customer in the process of making the final package;

FIG. 36 is a perspective view of the blank shown in FIG. 35 after the steps of pre-bending the sides and filling the package with a bundle;

FIG. 37 is a perspective view of the package shown in FIG. 36 showing the sealing sequence of both side panels;

FIG. 38 is a perspective view of the assembled package;

FIG. 39 is a perspective view of the assembled package shown in FIG. 38 after the package has been opened and the extension member being removed by a consumer;

FIG. 40 is a perspective view of the package shown in FIG. 39 while being opened by the consumer with the snap-lock member shown in dashed line;

FIG. 41 is a perspective view of some of the product being removed from the package shown in FIG. 40 by the consumer; and FIG. 42 is a perspective view of the package shown in FIG. 41;

FIG. 49A is a view analogous to the view illustrated in FIG. 49;

DESCRIPTION OF THE PREFERRED EMBODIMENTS

Reference is now made to the drawings in which the same or similar elements are indicated by the same numerals.

A new and novel dispensing package designated generally by the numeral 10 is shown in the process of assembly in FIGS. 1–11. The terms "manufacturer," "customer," and "consumer" used herein refer to the following: The manufacturer is an entity that prepares the blank into flat, or collapsed, partially assembled package for shipment to a customer of the manufacturer; the customer is the entity that erects the collapsed package, fills it with the product, and finishes the assembly and seals the package prior to shipment to a retailer; a consumer is the person who buys the package from the retailer, breaks the seal, and opens the package. The term "supplier" can refer to either a manufacturer or a customer.

Figure 8:
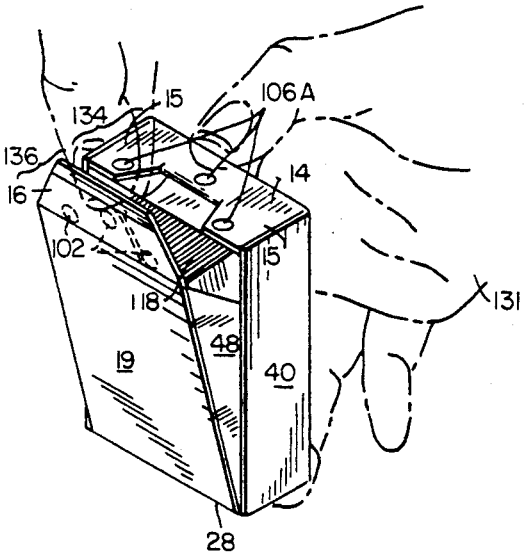
FIG. 8 is a perspective view of the package as shown in FIG. 7 showing the assembled and filled package being opened by a consumer.
Figure 9:
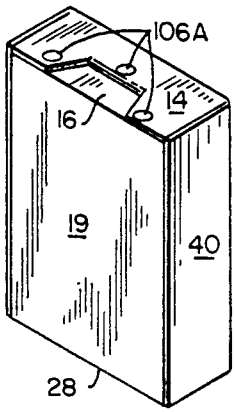
FIG. 9 is a perspective view of the package as shown in FIG. 8 after being closed by the consumer.
Figure 10:
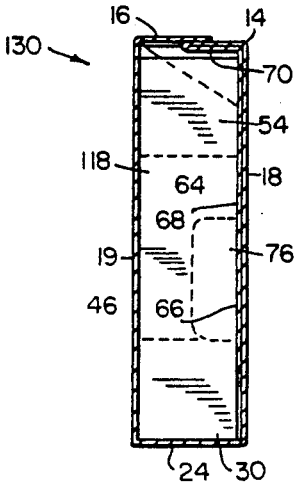
FIG. 10 is a cross-sectional view taken through plane 10—10 of FIG. 9A.
Figure 9A:
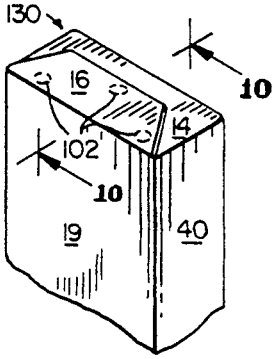
FIG. 9A is a partial perspective view of the assembled package prior to being initially opened by the consumer.

Dispensing package 10 is illustrated in its initial state in FIG. 1 as a unitary starting blank 12, which includes wall panels and connecting flaps described in terms such as top and bottom, upper and lower, and right and left in reference to the final assembled package illustrated in FIGS. 8, 9A, and 10. Starting blank 12 is shown with its inner surface facing upwardly in FIG. 1. A wide inner top wall panel 14 integrally including a pair of opposed, forwardly extending side portions 15 (see FIG. 8) and a wide outer top wall panel 16 are connected to a wide rear wall panel 18 and a wide front wall panel 19 at parallel top fold lines 20 and 22, respectively, which are at the opposite top sides of rear wall panel 18 and front wall panel 19, respectively. A bottom wall panel 24 is connected to rear wall panel 18 and front wall panel 19 at parallel bottom fold lines 26 and 28, respectively, which are generally opposite from top fold lines 20 and 22, respectively. A left lower connecting flap 30 and a right lower connecting flap 32 are connected to opposite sides of bottom wall panel 24 at parallel fold lines 34 and 36, respectively, which are connected to and aligned transverse to fold lines 26 and 28. A narrow left outer side wall panel 38 and a narrow right outer side wall panel 40 are connected to opposite sides of rear wall panel 18 at parallel fold lines 42 and 44, respectively, which are transverse to fold lines 20 and 26 and in genera extension of fold lines 34 and 36, respectively. A narrow left inner side wall panel 46 and a narrow right inner side wall panel 48 are connected to opposite sides of front wall panel 19 at parallel fold lines 50 and 52, respectively, which are connected to and transverse to fold lines 22 and 28 and in general extension of fold lines 30 and 36, respectively. A left upper connecting flap 54 and a right upper connecting flap 56 are connected to opposite sides of inner top wall panel 14 at parallel fold lines 58 and 60, respectively, which are connected to and transverse to fold line 20 and in general extension of fold lines 42 and 44, respectively. Flaps 30 and 32 are slightly spaced from and freely movable relative to left and right inner and outer side wall panels 38, 40 and 46, 52. Flaps 54 and 56 are slightly spaced from and freely movable relative to left and right outer side wall panels 38 and 40.

A toggle snap-lock member 62 is connected to the mid-area of inner top wall panel 14 at a fold line 63, which is lateral to fold line 20. Snap-lock member 62 includes an upper snap-lock portion 64; a lower snap-lock portion 66 connected to upper snap-lock portion at a fold line 68, which is lateral to fold line 63; a snap-lock upper connecting flap 70 connected to upper snap-lock portion 64 and to the mid are of inner top wall panel 14 at parallel fold lines 72 and 63, respectively, which are lateral to fold line 20; and a snap-lock left lower connecting flap 76 and a snap-lock right lower connecting flap 78 connected to opposite sides of snap-lock lower portion 66 at parallel fold lines 80 and 82, respectively, which are transverse to fold line 68. Lower snap-lock portion 66 has a cutout 84 opposite fold line 68. Upper connecting flap 70 extends between and is movable at fold line 63 relative to extending side portions 15 of top wall panel 104.

Three triangularly spaced circular glue, or adhesive, areas 102 are placed on the inner surface of outer top wall panel 16. Also, an elongated adhesive strip 104 is placed on the inner surface of inner top wall panel 14, strip 104 being transverse to and located between fold lines 20 and 63.

After the steps of setting out starting blank 12 and placing adhesives 102 and 104, the manufacturer performs the next step as shown in FIG. 2, namely, folding over snap-lock member 62 along fold line 63 so that snap lock member 62 is positioned upon the inner surface of inner top wall panel 14 and of rear wall panel 18 and left with left and right panels 76 and 78 positioned upon left and right outer side wall panels 38 and 40. Next, snap-lock upper connecting flap 70 is pressed against the inner surface of inner top wall panel 14 so that adhesive strip 104 adheres inner top wall panel 14 with snap-lock upper connecting flap 70.

The following step, shown in FIG. 3, is folding over rear wall panel 18 together with left and right outer wall panels 38 and 40 and left and right upper connecting flaps 54 and 56 along fold line 26 over front wall panel 19, bottom wall panel 24, left and right inner side wall panels and 48, and left and right lower connecting flaps 30 and 32. Three triangularly positioned, circular, layered breakaway tabs 106 are illustrated positioned on the outer surface of inner top wall panel 14.

The next step, shown in FIG. 4, is folding over outer top wall panel 16 along fold line over inner top wall panel 14 so that the three adhesive areas 102 come into adhesive contact with the breakaway tabs 106. This completes the manufacturer's assembly process into the final collapsed form 108. The reverse side of final collapsed form 108 of the dispensing package is shown in FIG. 5, where front wall panel 19, left and right inner side wall panels 46 and 48, bottom wall panel 24, and left and right lower connecting flaps 30 and 32 are positioned in the upper position. Collapsed form 108 is shipped to a customer who in turn begins another series of steps to the final erected assembly from collapsed form 108.

The customer's assembly process begins with collapsed form 108 shown in FIGS. 4 and 5 by the placement of a pair of adhesive strips 110 on the inner surfaces of left and right upper connecting flaps 54 and 56, respectively; by the placement of adhesive strips 116 on the inner surfaces of left and right lower connecting flaps 30 and 32; and by the placement of adhesive strips 117 on the outer surfaces of left and right inner side wall panels 46 and 48.

Figure 6:
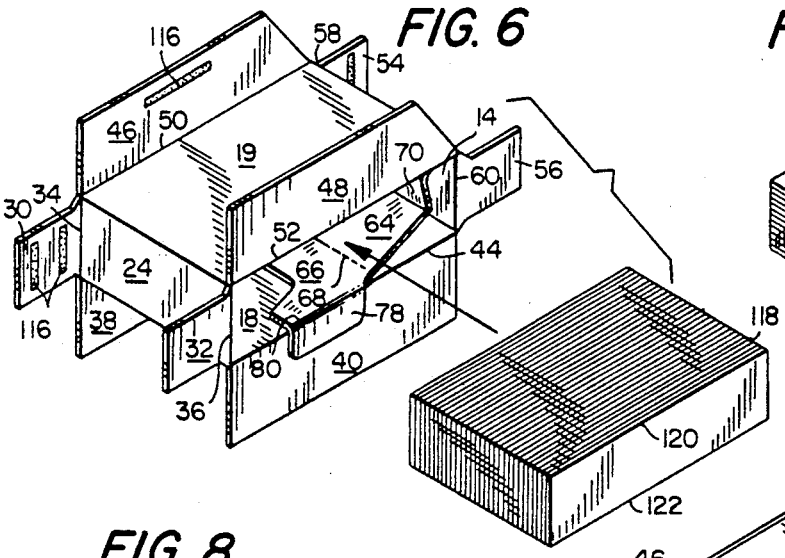
FIG. 6 is a perspective view of the package showing a pre-bending and erecting of the package by a customer from the collapsed form shown in FIG. 5.
Figure 6A:
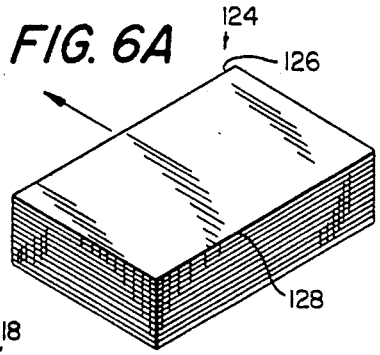
FIG. 6A is a perspective view of an alternative bundle of wide-bodied items for filling the erected package shown in FIG. 6.

The next step performed by the customer is the prebending and erecting of collapsed form 108 to an erected package as shown in FIG. 6. Rear and front wall panels 18 and 19, and bottom wall panel 24 and inner and outer top wall panels 14 and 16 are shifted into direct, opposed alignment; and left and right outer side wall panels 38 and 40, left and right inner side wall panels 46 and 48, left and right lower connecting flaps 30 and 32, and left and right upper connecting flaps 54 and 56 are aligned along their respective fold lines 42 and 44, 50 and 52, 34 and 36, and 58 and 60 in outward, transverse orientation relative to rear and front wall panels 18 and 19 inner and outer top wall panels 14 and 16, and bottom wall panel 24. Also, left and right lower snap-lock connecting flaps 76 and 78 are folded along fold lines 80 and 82 in lateral, abutting relationship with the inner surfaces of left and right outer side wall panels 38 and 40. Next, a product comprising a bundle, or stack, of a plurality of separate, elongated items 118 to be sold, such as sticks of gum or band aids is slid into the empty compartment formed by the erected package through an open side formed between rear and front wall panels 18 and 19 and inner top wall panel 14 and bottom wall panel 24. Items 118 have elongated, opposite side walls 120 and 122, which are each in relationship with front wall panel 19 and rear wall panel 18, respectively, and more particularly, side walls 120 and 122 are in relationship with snap-lock member 62. Alternatively, a bundle, or stack, of wide-bodied packets 124, such as soup packets, having opposite front and rear sides 126 and 128, respectively, can be slid into the package in the same manner as items 118 with the lead front side 126 in relationship with front wall panel 19 and the trailing rear side 128 in relationship with rear wall panel 18, and more particularly, with snap-lock member 62. Upper and lower snap-lock portions 64 and 66 are pressed into abutting relationship with the inner surface of rear wall panel 18 so that left and right lower snap-lock connecting flaps 76 and 78 are positioned along left and right outer side wall panels 38 and 40. In addition, snap-lock upper connecting flap 70 is now erect being connected to erected inner top wall panel 14, and upper snap-lock portion 64 is now bent at right angles to snap-lock upper connecting flap 70 along fold line 20 (not seen in FIG. 6).

Figure 7:
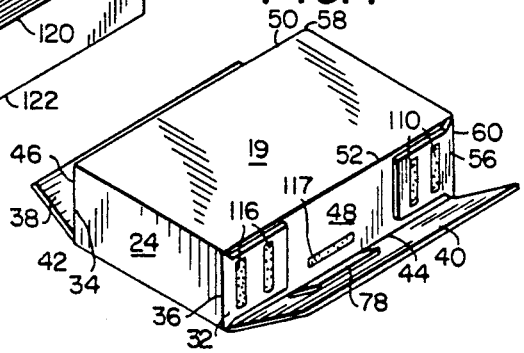
FIG. 7 is a perspective view of the package as shown in FIG. 6 after the step of adhesively securing the side panels and the snap-lock member.

FIG. 7 illustrates the completion of the following steps performed by the customer, namely, the closing and the sealing of the package. In particular, the next step is folding left and right inner side wall panels 46 and 48 inwards along fold lines 50 and 52 so as to close the open sides of the packet. Next, left and right lower connecting flaps 30 and 32 are folded inwards along fold lines 34 and 36 and left and right upper connecting flaps 54 and 56 along fold lines 58 and 60 to abutting relationship with the outer surfaces of left and right inner side wall panels 46 and 48. The following step is folding left and right outer side wall panels 38 and 40 along fold lines 42 and 44 inwards into abutting and sealing relationship with left and right lower connecting flaps 30 and 32 and left and right upper connecting flaps 54 and 56 by way of the adhesion of adhesive strips 116 and 110 with the inner surface of left and right outer side wall panels 38 and 40. When left and right outer side wall panels are folded along fold lines 42 and 44 against left and right lower and upper flaps 30 and 32 and 54 and 56, left and right lower snap-lock connecting flaps are carried into abutting and adhering relationship with adhesive strips 117 on the outer surfaces of left and right inner side wall panels 46 and 48. The final assembled package 130 is shown in FIGS. 9A and 10.

Final assembled package 130 includes four upright wall panels including a wide front wall panel 19 and an opposed wide rear wall panel 18 and a pair of narrow left and right outer side wall panels 38 and 40, which are transverse to rear and front wall panels 18 and 19 and are connected to rear wall panel 18. A bottom wall panel 24 is connected and transverse to rear and front wall panels 18 and 19 and left and right outer side wall panels 38 and 40; and an inner top wall panel 14 opposed to bottom wall panel 24 is connected and transverse to outer side wall panels 38 and 40 and rear wall panel 18. An outer top wall panel 16 abutting inner top wall panel 14 is connected to front wall panel 19, and a pair of narrow left and right inner side wall panels 46 and 48 abutting left and right outer side wall panels 38 and 40 are connected to front wall panel 19 and bottom wall panel 24.

Figure 19:
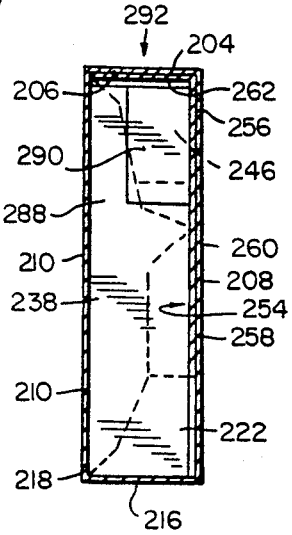
FIG. 19 is a sectional view taken through plane 20—20 of FIG. 19A.

An outer shell 134 of assembled package 130 is defined by rear wall panel 18, outer side wall panels 38 and 40, inner top wall panel 14, and bottom wall panel 24. Outer shell 134 has a wide rectangular opening opposite rear wall panel 18 that is substantially defined by the forward edges of outer top wall panel 16, outer side wall panels 38 and 40, and bottom wall panel 24. An inner shell 136 is defined by front wall panel 19, inner side wall panel 46 and 48, and bottom wall panel 24, inner shell 136 forming a compartment that contains bundle 118. Bottom wall panel 24 is common to both outer and inner shells 134 and 136. Inner shell 136 is positioned in outer shell 136 when assembled package 130 is in a closed mode as seen in FIG. 19. Inner shell 136 is rotatably movable relative to outer shell 134 at fold line 28 between the closed, or first, position wherein inner shell 136 is completely positioned within outer shell 134 and wherein bundle 188, which is held in inner shell 136, is inaccessible; and an open, or second, position wherein inner shell 136 is rotated partially out of the confines of outer shell 134 through the rectangular opening opposite rear wall panel 18 and wherein the entire contents of bundle 118 in the compartment of inner shell 136 is accessible.

Figure 11:
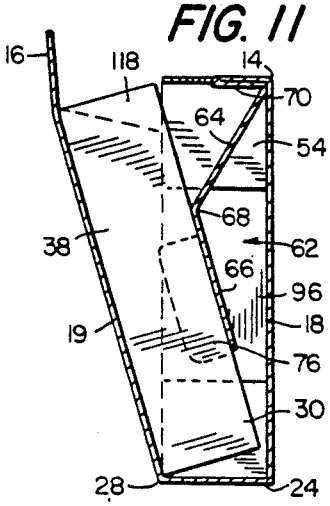
FIG. 11 is a cross-sectional view of the open package combining aspects of the views shown in FIGS. 8 and 10 illustrating the snap lock retaining the packing in the open position.

FIG. 8 illustrates the hand of a consumer 131 after breaking open assembled package 130 by lifting outer top wall panel 16 from inner top wall panel 14 so as to tear away the breakaway tabs 106 from inner top wall panel 14 leaving tab indents, or hollows, 106A. Top wall panel 14 has a center opening 107 defined in part by side portions 15 that allows consumer 131 better finger-gripping access to bundle 118. FIG. 11 is a sectional side view of assembled dispensing package 130 as illustrated in FIG. 8. Customer 132 also has pulled front wall panel 19 away from left and right outer side wall panels 38 and 40 and inner top wall panel 14 by rotation along fold line 28, that is, pulled inner shell 132 from its first position to its second position so as to make the plurality of items 118 fully accessible so that consumer 131 can select any of items 118. When packets 124 are positioned in the compartment of inner shell 132, at least one entire packet 124 is accessible to being removed by consumer 131.

After consumer 131 has removed an item 118 from inner shell 132, the consumer pushes inner shell 132 from its second position to its first position within outer shell 134 as illustrated in FIG. 9.

Because toggle snap-lock member 62 is connected by way of left and right lower snap-lock connecting flaps 76 and 78 to the outer surfaces of left and right inner side wall panels 46 and 48, which are part of inner shell 132, when inner shell 132 is pulled or pushed between its first and second positions, respectively, toggle snap-lock member 62 is also moved between first and second toggle locking positions. Toggle snap-lock member 62, in particular upper and lower snap-lock portions 64 and 66, are in abutting relationship with the inner surface of rear wall panel 18 when inner shell 132 is in its first position; and upper and lower snap-lock portions 64 and 66 are pulled away to a spaced relationship with rear wall panel 18 with fold line 68 spaced away from rear wall panel 18 when inner shell 132 is in its second position. When inner shell 132 is in its first position, toggle snap-lock member 62 is in a first toggle on-center locking position that holds inner shell 132 in its first position, and when inner shell 132 is in its second position, toggle snap-lock member is in a second toggle past-center locking position that holds inner shell 132 in its second position Thus, toggle snap-lock member 62 prevents inner shell 132 from being accidentally moved from either from its first or second position.

FIG. 9 illustrates assembled dispensing package 130 after consumer 131 has mover inner shell 136 back into outer shell 134 with outer top wall panel 16 now tucked under inner top wall panel 14.

FIG. 9A illustrates a partial perspective of unopened assembled package 130 and FIG. 10 is a full sectional view of assembled package 130 with inner shell 132 and toggle snap-lock member 62 in their first positions.

FIG. 11 illustrates a full sectional view of assembled package 130 analogous to the sectional view shown in FIG. 10 with inner shell 132 and toggle snap-lock member 62 in their second positions.

A second embodiment of the present invention designated generally as dispensing package 200 is shown in the process of assembly in FIGS. 12–20. A unitary starting blank 202 illustrated in FIG. 12 includes wall panel and connecting flaps, which are described in terms such as top and bottom, upper and lower, and right and left in reference to the final assembled package illustrated in FIGS. 16–20. Starting blank 202 is shown with its inner surface facing upwardly in FIG. 12. A wide outer top wall panel 204 having a pair of forwardly extending side panels 205 (see FIG. 18) and a wide inner top wall panel 206 having a front edge 207 are connected to a wide rear wall panel 208 and a wide front wall panel 210 at parallel top fold lines 212 and 214, respectively, which are at the opposite top sides of rear wall panel 208 and front wall panel 210, respectively. A bottom wall panel 216 is connected to rear wall panel 208 and front wall panel 210 at parallel bottom fold lines 218 and 220, respectively, which are generally opposite from top fold lines 212 and 214, respectively. A left lower connecting flap 222 and a right lower connecting flap 224 are connected to opposite sides of bottom wall panel 216 at parallel fold lines 226 and 228, respectively, which are connected to and aligned transverse to fold lines 218 and 220. A narrow left outer side wall panel 230 and a narrow right outer side wall panel 232 are connected to opposite sides of rear wall panel 208 at parallel fold lines 234 and 236, respectively, which are connected to and transverse to fold lines 212 and 218 and in general extension of fold lines 226 and 228, respectively. A narrow left inner side wall panel 238 and a narrow right inner side wall panel 240 are connected to opposite sides of front wall panel 210 at parallel fold lines 242 and 244, respectively, which are connected to and transverse to fold lines 214 and 220 and in general extension of fold lines 222 and 228, respectively. A left upper connecting flap 246 and a right upper connecting flap 248 are connected to opposite sides of outer top wall panel 204 at parallel fold lines 250 and 252, respectively, which are connected to and transverse to fold line 212 and in general extension of fold lines 234 and 236, respectively, and are spaced from left and right inner side wall panels 238 and 240. Flaps 222 and 224 adjoin and are freely movable relative to left and right outer side wall panels 230 and 232. Flaps 246 and 248 adjoin and are freely movable relative to left and right outer wall panels 230 and 232.

A toggle snap-lock member 254 is connected to the mid-area of outer top wall panel 204 at a fold line 255, which is lateral to fold line 212. Snap-lock member 254 includes an upper snap-lock portion 256; a lower snap-lock portion 258 connected to upper snap-lock portion 256 at a fold line 260, which is lateral to fold line 255; a snap-lock upper connecting flap 262 connected to upper snap-lock portion 256 and to the mid area of outer top wall panel 204 at parallel fold lines 264 and 255, respectively, which are lateral to fold line 212; and a snap-lock left lower connecting flap 268 and a snap-lock right lower connecting flap 270 connected to opposite sides of snap-lock lower portion 258 at parallel fold lines 272 and 274, respectively, which are transverse to fold line 260. Lower snap-lock portion 66 has a cutout 276 opposite fold line 63. Upper connecting flap 262 extends between and is movable at fold line 255 relative to extending side portions 205 of top wall panel 208.

Figure 12:
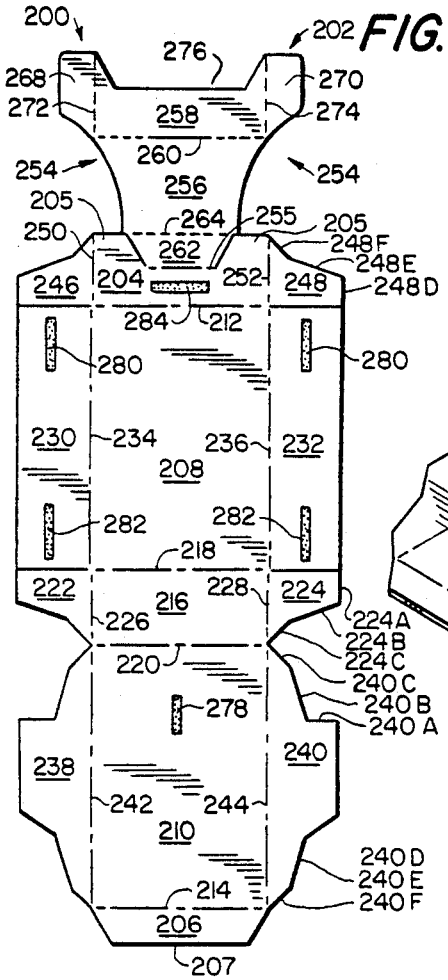
FIG. 12 is a plan view of a unitary starting blank of a second embodiment of the present invention.
Figure 15:
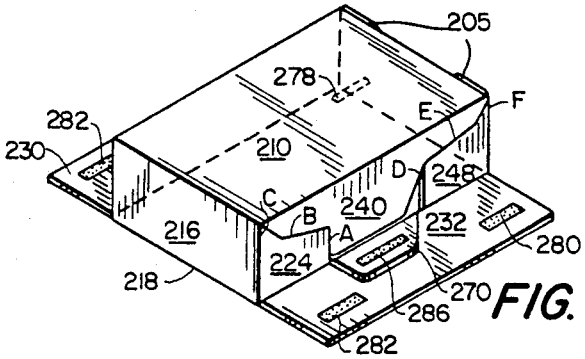
FIG. 15 is a perspective view of the partially assembled dispensing package illustrated in FIG. 14 showing the completion of the folding step of FIG. 14 and indicating the final folding and adhesive securing.

As illustrated best in FIGS. 12 and 15, left and right inner side wall panels 238 and 240 are configured to dovetail with left and right lower connecting flaps 222 and 224 and left and right upper connecting flaps 246 and 248 when the package is assembled. With wall panel 240 and flaps 224 and 240 as exemplaries, wall panel 240 has a lower straight edge portion 240A, a continuing angled edge portion 240, and another continuing angled edge portion 242 that mate with lower flap 224 at a lower straight edge portion 224A, a continuing angled edge portion 224B, and another continuing angled edge portion 224C, respectively. Wall panel 240 also has an upper straight edge portion 240D, a continuing angled edge portion 240E, and another continuing angled edge portion 240F that mate with upper flap 248 at an upper straight edge portion 248D, a continuing angled edge portion 248D, and another continuing angled edge portion 248E, respectively. The combined mating edges are indicated as mating edges A, B, C, D, E, and F in FIG. 15.

An adhesive strip 278 is placed on the inner surface of front wall panel 210. Adhesive strips 280 are placed on the upper surfaces of left and right outer side wall panels 230 and 232; and adhesive strips 282 are placed on the lower surfaces of left and right outer side wall panels 230 and 232. An adhesive strip 284 is placed at the center of the inner surface of outer top wall panel 204.

Figure 13:
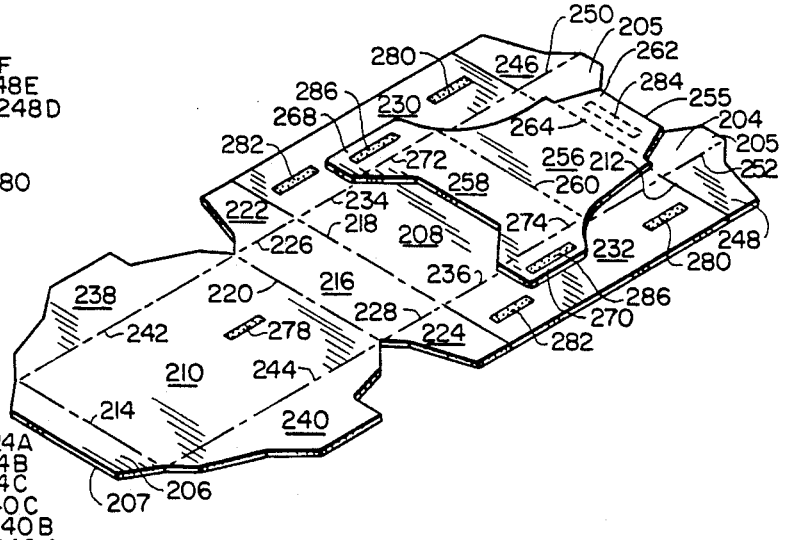
FIG. 13 is a perspective view of the blank shown in FIG. 12 after the first step of folding over and securing an adhesive area in assembling an erected package by a manufacturer or a customer.

After the steps of setting out starting blank 12 and placing adhesive strips 278, 280, 282, and 284, the manufacturer performs the next step as illustrated in FIG. 13, namely, folding over snap-lock member 254 along fold line 255 so that snap lock-member 254 is positioned upon the inner surface of outer top wall panel 204 and the inner surfaces of rear wall panel 208 and left and right outer wall panels 230 and 232. Next, snap-lock upper connecting flap 262 is pressed against the inner surface of outer top wall panel 204 so that adhesive strip 284 joins the inner surface of outer top wall panel 204 with snap-lock upper connecting flap 262. Adhesive strips 286 are placed on the inner surface of left and right lower snap-lock connecting flaps 268 and 270.

Figure 14:
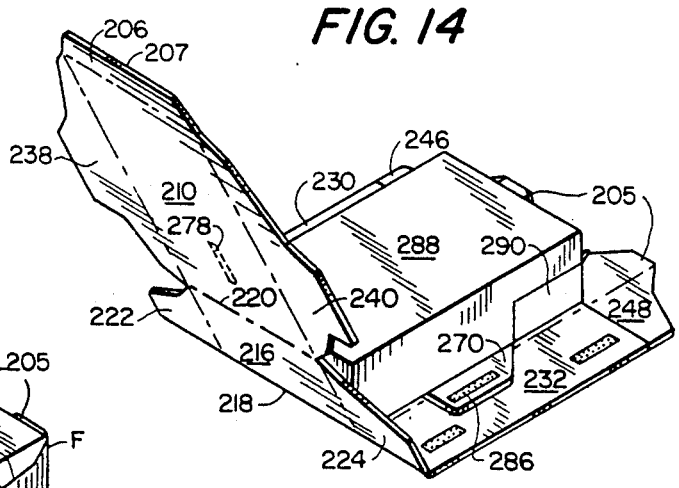
FIG. 14 is a perspective view of the blank shown in FIG. 13 after the steps of placing a bundle of cigarettes onto the blank and folding by the supplier.

FIG. 14 illustrates the following step by a customer of placing a cigarette bundle 288 having a removable foil top 290 between fold lines 264 and 218 upon rear wall panel 208 and snap-lock member 254 with foil top 290 being positioned at the upper rear portion of the package adjacent upper snap-lock portion 256. Then front wall panel 210 with bottom wall panel 216 with left and right lower and upper connecting flaps 222, 224 and 238, 240 are rotated towards bundle 290 about fold line 218.

FIG. 15 illustrates the following step by the supplier of covering bundle 288 with front wall panel 210 and folding left and right lower and upper connecting flaps 222, 224 and 238, 240 inwardly into abutting relationship with the side wall panels of bundle 286. In addition, left and right inner side wall panels 238 and 240 are folded over the side wall panels of bundle 286 into mating alignment with lower and upper connecting flaps 222, 224 and 238, 240 at the mating areas exemplified by mating areas A, B, C, D, E, and F as described earlier. Left lower and upper connecting flaps 222 and 246 form a single layered side wall panel with left inner side wall panel 238 in the assembled position; and right lower and upper connecting flaps 224 and 248 form a single layered side wall panel with right inner side wall panel 240 in the assembled position. Also, adhesive strip 278 adheres the inner surface of front wall panel 210 to the front wall panel of bundle 286. Side panels 205 of outer top wall panel 204 overlie inner top wall panel 206.

Figure 15A:
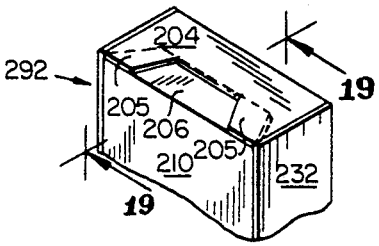
FIG. 15A is a partial perspective view of the assembled package after the step shown in FIG. 15.

The following step is folding left and right outer side wall panels 230 and 232 about fold lines 234 and 236 until adhesive strips 282 adhere side wall panels 230 and 232 to lower flaps 222 and 224 and adhesive strips 280 adhere left and right outer side wall panels 230 and 232 to upper flaps 238 and 240. When side wall panels 230 and 232 are rotated, left and right lower snap-lock connecting flaps 268 and 270 are also rotated about fold lines 272 and 274 and adhesive strips 285 adhere flaps 268 and 270 to the outer surface of left and right inner side wall panels 238 and 240. These steps result in an assembled dispensing package 292 shown in partial perspective view in FIG. 15A in an upright position in accordance with the orientation descriptive designations used throughout herein. Outer top wall panel 204 slightly overlies inner top wall panel 206 with side panels 205 of outer top wall panel 204 slightly overlaying the sides of inner top wall panel 206 and front edge 207 of inner top wall panel 206 tucked slightly under the middle area of outer top wall panel 204.

Final assembled package 290 includes four upright wall panels including a wide front wall panel 210 and an opposed wide rear wall panel 208 and a pair of opposed narrow left and right outer side wall panels 230 and 232, which are transverse to rear and front wall panels 208 and 210 and are connected to rear wall panel 208. A rectangular bottom wall panel 216 is connected and transverse to rear and front wall panels 208 and 210 and left and right outer side wall panels 230 and 232. An outer top wall panel 204 opposed to bottom wall panel 216 is connected and transverse to left and right outer side wall panels 230 and 232 and rear wall panel 208. An inner top wall panel 206 abutting outer top wall panel 204 is connected to front wall panel 210. A pair of opposed narrow left and right inner side wall panels 238 and 240 abutting left and right outer side wall panels 230 and 232 are connected to front wall panel 210 and bottom wall panel 216.

An outer shell 294 of assembled package 292 is defined by rear wall panel 208, outer side wall panels 230 and 232, outer top wall panel 204, and bottom wall panel 216. Outer shell 294 has a wide rectangular opening opposite rear wall panel 208 that is substantially defined the forward edges of outer top wall panel 204, outer side wall panels 230 and 232, and bottom wall panel 216. An inner shell 296 is defined by front wall panel 210, inner side wall panels 238 and 240, and bottom wall panel 216, inner shell 296 forming a compartment that contains bundle 288. Bottom wall panel 216 is common to both inner and outer shells and 134. Inner shell 296 is positioned in outer shell 294. Inner shell 296 is rotatably movable relative to outer shell 294 at fold line 218 between a closed, or first, position wherein inner shell 296 is completely positioned within outer shell 294 and wherein bundle 288 held in inner shell 296 is inaccessible, and an open, or second, position wherein inner shell 296 is rotated partially out of the confines of outer shell 294 through the rectangular opening opposite rear wall panel 208 and wherein the entire contents of bundle 288 in the compartment of inner shell 296 is accessible.

Figure 16:
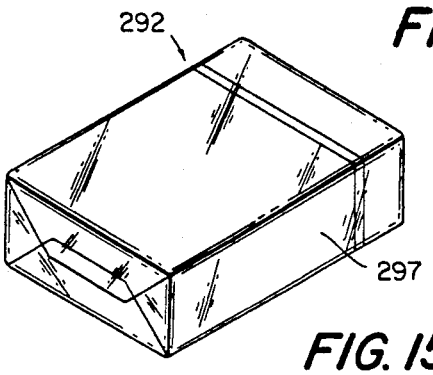
FIG. 16 is a perspective view of the assembled dispensing package shown in FIG. 15 including a conventional plastic overwrap.

FIG. 16 illustrates the result of the next step of placing a plastic wrap 297 about assembled dispensing package 292.

Figure 17:
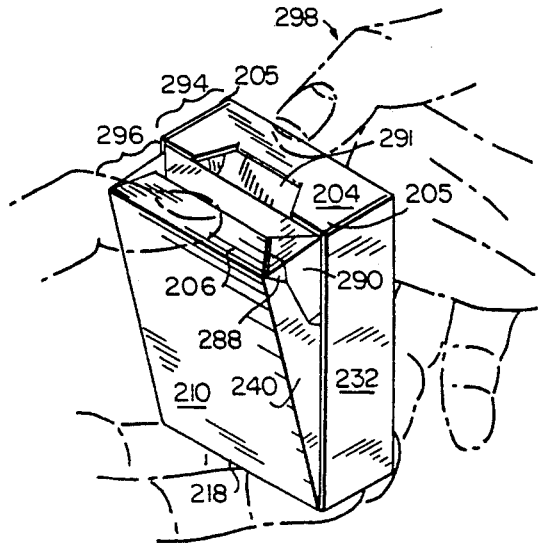
FIG. 17 is a perspective view of a consumer opening the assembled package illustrated in FIGS. 16 and 15A.
Figure 18:
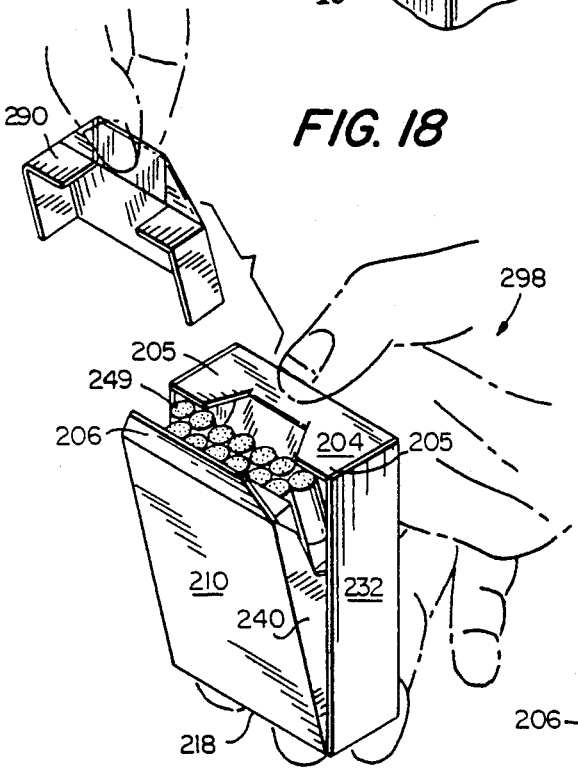
FIG. 18 is a perspective view illustrating the consumer removing the foil top from the bundle of cigarettes in the assembled package shown in FIG. 17.

FIG. 17 illustrates inner shell 296 having been rotated from its first positioned described above into it second position by a consumer 298 so that bundle 288 with foil top 290 exposed. FIG. 18 illustrates consumer 298 having removed foil top 290 from bundle 288 so as to expose the entire array of cigarettes 299. Top wall panel 204 has a center opening 291 defined in part by side panels 205 so as to allow consumer 298 better access to bundle 288.

Because toggle snap-lock member 254 is connected by way of left and right lower snap-lock connecting flaps 268 and 270 to the outer surfaces of left and right inner side wall panels 238 and 240, which are part of inner shell 296, when inner shell 296 is pulled or pushed between its first and second positions, respectively, toggle snap-lock member 254 is also moved between first and second toggle locking positions, respectively. Toggle snap-lock member 254, in particular upper and lower snap-lock portions 256 and 258, are in abutting relationship with the inner surface of rear wall panel 208 when inner shell 296 is in its first position; and upper and lower snap-lock portions 256 and 258 are pulled away to a spaced relationship with rear wall panel 208 with fold line 260 spaced away from rear wall panel 208 when inner shell 296 is in its second position. When inner shell 296 is in its first position, toggle snap-lock member 254 is in a first toggle on-center locking position at a center position that holds inner shell 296 in its first position, and when inner shell 296 is in its second position, toggle snap-lock member 254 is in a second toggle past-center locking position that holds inner shell 296 in its second position. Thus, toggle snap-lock member 254 prevents inner shell 296 from being accidentally moved from either from its first or second position.

FIG. 19 illustrates a full sectional view of assembled package 292 with inner shell 296 and toggle snap-lock member 254 in their first positions.

Figure 20:
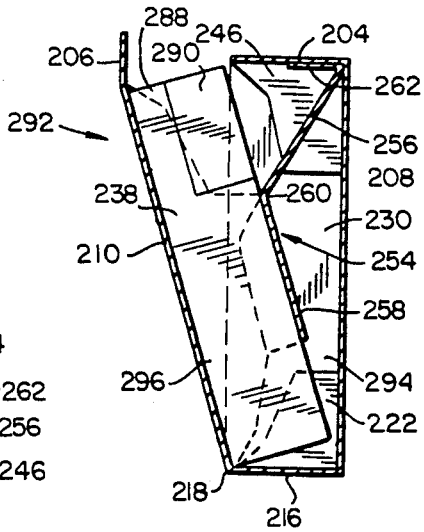
FIG. 20 is a sectional view of the opened dispensing package shown in FIG. 18 showing the toggle snap-lock member holding the package in the open position.

FIG. 20 illustrates a full sectional view of assembled package 292 analogous to the sectional view shown in FIG. 19 with inner shell 296 and toggle snap-lock member 254 in their second positions.

A third embodiment of the present invention designated generally a s dispensing package 300 is shown in the process of assembly in FIGS. 21-30.

Figure 21:
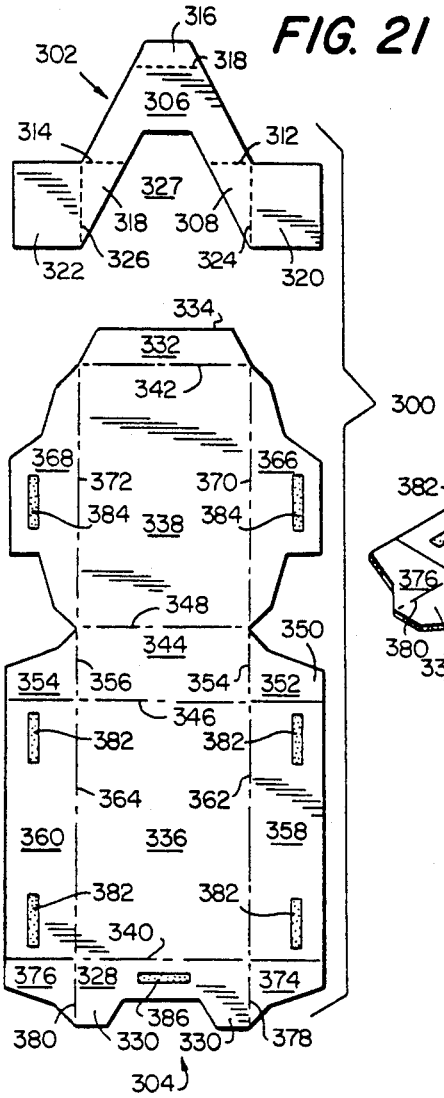
FIG. 21 is a view of a third embodiment of the present invention including plan views of a two-piece blank for a wide-opening dispensing package that includes a toggle snap-lock blank and main blank.

Dispensing package 300 is made from a starting two-piece blank that includes a toggle snap-lock blank 302 and a main blank 304 illustrated in FIG. 21. Blanks 302 and 304 are reversed relative to the final left/right orientation of the final assembled package shown in FIGS. 25, 27, and 28, which is the designation used for the description of dispensing package 300. Toggle snap-lock blank 302 includes an upper snap-lock portion 306 and left and right triangular lower front snap-lock portions 308 and 310, respectively, connected to top snap-lock portion 306 at a pair of transverse, aligned left and right fold lines 312 and 312, respectively, which can be considered as a single fold line. A top connecting flap 316 is connected to top wall panel 306 at transverse fold line 318. A pair of left and right connecting flaps are connected to front snap-lock portions 308 and 310, respectively, at a pair of lateral, parallel left and right fold lines 324 and 326, respectively. Upper snap-lock portion has a center cutout 327.

Main blank 304 is shown with its inner surface facing upwardly in FIG. 21. A wide outer top wall panel 328 including a pair of forwardly extending side panels 330 (see FIG. 27) and a wide inner top wall panel 332 having a front edge 334 are connected to a wide rear wall panel 208 and a wide front wall panel 210 at parallel top fold lines 340 and 342, respectively, which are at the opposite top sides of rear wall panel 336 and front wall panel 338, respectively. A bottom wall panel 344 is connected to rear wall panel 336 and front wall panel 338 at parallel bottom rear and front fold lines 346 and 348, respectively, which are generally opposite from top fold lines 340 and 342, respectively. A left lower connecting flap 350 and a right lower connecting flap 352 are connected to opposite sides of bottom wall panel 344 at parallel fold lines 354 and 356, respectively, which are connected to and aligned transverse to fold lines 344 and 346. A narrow left outer side wall panel 358 and a narrow right outer side wall panel 360 are connected to opposite sides of rear wall panel 336 at lateral left and right fold lines 362 and 364, respectively, which are connected to and transverse to fold lines 340 and in general extension of fold lines 362 and 364, respectively. A narrow left inner side wall panel 366 and a narrow right inner side wall panel 368 are connected to opposite sides of front wall panel 338 at parallel fold lines 370 and 372, respectively, which are connected to and transverse to fold lines 342 and 348 and in general extension of fold lines 370 and 372, respectively. A left upper connecting flap 374 and a right upper connecting flap 376 are connected to opposite sides of outer top wall panel 338 at parallel fold lines 378 and 380, respectively, which are connected to and transverse to fold line 340 and in general extension of fold lines 362 and 364, respectively. Flaps 350 and 352 adjoin and are freely movable relative to left and right outer side wall panels 358 and 360 and are spaced from left and right inner side wall panels 366 and 368. Flaps 374 and 376 adjoin and are freely movable relative to left and right outer wall panels 358 and 360.

Figure 24:
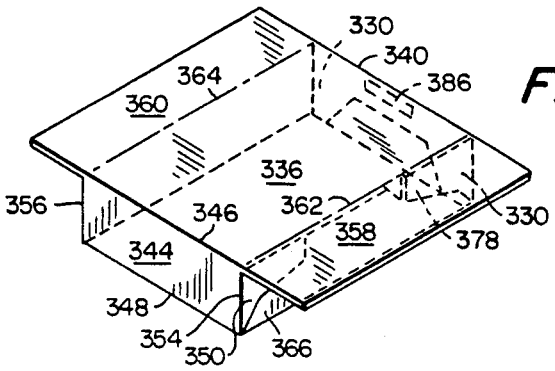
FIG. 24 is a perspective view of the package shown in FIG. 23 after making second and third folding steps by the manufacturer or customer.

As illustrated best in FIGS. 21 and 24, left and right inner side wall panels 366 and 368 are configured to dovetail with left and right lower connecting flaps 352 and 354 and left and right upper connecting flaps 374 and 376 when the package is assembled. These dovetails are the same as the dovetails previously described relative to disposal package 200 and FIGS. 12 and 15 with wall panel 240 and flaps 224 and 248 as exemplaries, which are analogous to wall panel 360 and flaps 352 and 376, respectively.

A pair of adhesive strips 382 are placed at the upper and lower portions of the inner surfaces of left and right outer side wall panels 356 and 360. A pair of adhesive strips 384 are placed on the inner surfaces of left and right inner side wall panels 366 and 368. An adhesive strip 386 is placed on the inner surface of outer top wall panel 328.

Figure 22:
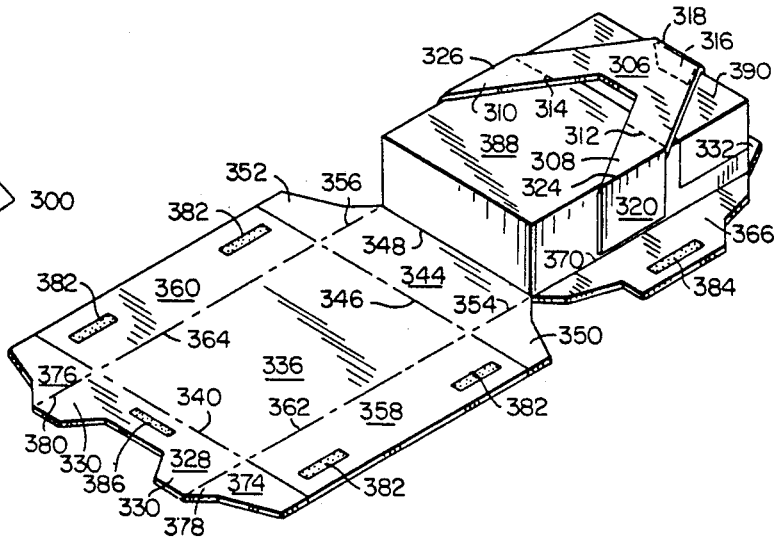
FIG. 22 is a perspective view of the blanks shown in FIG. 22 after the first steps by the manufacturer or the customer of placing a cigarette package upon the main blank and placing the snap-lock blank over the cigarette package.

After the steps of setting out starting blanks 302 and 304 and placing adhesives strips 384 and 386, a customer performs the next step as illustrated in FIG. 22, namely, placing a bundle of cigarettes 388 including a removable foil top 390 onto front wall panel 338 and then laying snap-lock blank 302 over bundle 388 with left and right connecting flaps 320 and 322 of snap-lock blank 302 folded downwardly along left and right fold lines 324 and 326 along the sides of bundle 388 and top flap 316 downwardly along transverse fold line 318 along the top of bundle 388. Snap-lock blank 302 in this step assumes the function of a snap-lock member and will be referred to as snap-lock member 302A.

Figure 23:
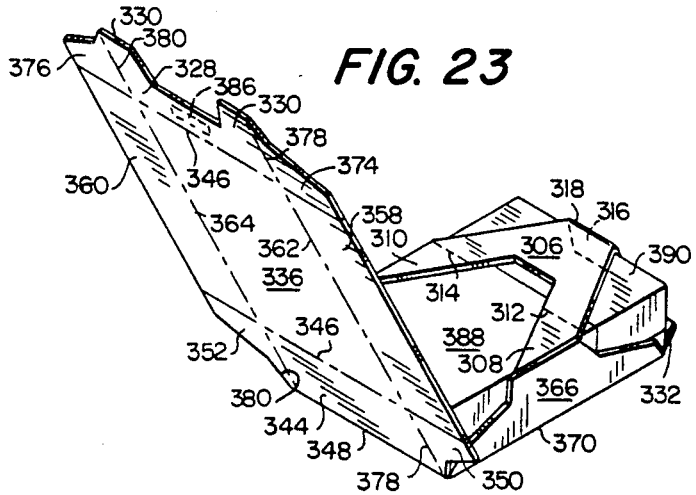
FIG. 23 is a perspective view of the package shown in FIG. 22 after placing a bundle upon the main blank and placing the snap-lock blank over the bundle.

FIG. 23 illustrates the next step by the customer of folding left and right inner side wall panels 366 and 368 along fold lines 370 and 372 over left and right connecting flaps 320 and 322 of snap-lock member 302A, and connecting flaps 366 and 368 to flaps 320 and 322 by way of adhesive strips 384 so that snap-lock member 302A is indirectly connected to front wall panel 338 below fold line 312. In addition, rear wall panel 336 with left and right outer side wall panels 358 and 360, bottom wall panel 344 with left and right lower flaps 350 and 352, and outer top wall panel 328 with left and right upper flaps 374 and 376 are shown being rotated about transverse front fold line 348 toward the position illustrated in FIG. 24, where rear wall panel 336 has been fully rotated to a position lying on top of snap-lock 302A with outer top wall panel 328 rotated along fold line 346 so as to overlie the outer surface of inner top wall panel 332 with side panels 330 in particular overlying inner top wall panel 332. In particular the inner surface of outer top wall panel 328 is connected to the outer surface of top flap 316 of snap-lock member 302A by way of adhesive strip 386 so that snap-lock member 302A is indirectly connected to rear wall panel 336 by way of inner top wall panel 328 above fold line 312. FIG. 24 also illustrates left and right lower flaps 350 and 352 having been rotated about fold lines 354 and 356 to a position adjoining the side wall panels of bundle 388 in mating alignment with inner side wall panels 366 and 368; and left and right upper flaps 374 and 376 having been rotated about fold lines 378 and 380 to a position adjoining the side wall panels of bundle 388 in mating alignment with inner side wall panels 366 and 368.

The last step in the basic assembly process, which follows in accordance with the completion of the steps illustrated in FIG. 24, is the folding of left and right outer side wall panels 358 and 360 along fold lines 362 and 364 downwardly against the outer surfaces of left and right inner side wall panels 366 and 368 where outer side wall panels 358 and 360 are secured to inner side wall panels 366 and 368 by way of adhesive strips 382.

The assembly steps set forth above result in an assembled dispensing package 392 shown in partial perspective view in FIG. 25 in an upright position and in accordance with the orientation descriptive designations used throughout herein. It is noted that the orientation of FIGS. 25–30 is reversed from the orientation of FIGS. 21–24 illustrated in the assembly procedure. Outer top wall panel 328 slightly overlies inner top wall panel 332 with side panels 330 of outer top wall panel 328 slightly overlaying the sides of inner top wall panel 332 and front edge 334 of inner top wall panel 332 tucked slightly under the middle area of outer top wall panel 328.

Final assembled package 392 includes four upright walls including rectangular wide front wall panel 338 and an opposed rectangular wide rear wall panel 336 and a pair of opposed narrow rectangular left and right outer side wall panels 358 and 360, which are transverse to rear and front wall panels 336 and 338 and are connected to rear wall panel 336. A rectangular bottom wall panel 344 is connected and transverse to rear and front wall panels 336 and 338 and left and right outer side wall panels 358 and 360. An outer rectangular top wall panel 328 opposed to bottom wall panel 344 is connected and transverse to left and right outer side wall panels 358 and 360 and rear wall panel 336. An inner top wall panel 332 abutting outer top wall panel 328 is connected to front wall panel 338. A pair of opposed narrow left and right inner side wall panels 366 and 368 abutting left and right outer side wall panels 358 and 360 are connected to front wall panel 338 and bottom wall panel 344.

An outer shell 394 of assembled package 392 is defined by rear wall panel 336, outer side wall panels 358 and 360, outer top wall panel 328, and bottom wall panel 344. Outer shell 394 has a wide rectangular opening opposite rear wall panel 336 that is substantially defined by the forward edges of outer top wall panel 328, outer side wall panels 358 and 360, and bottom wall panel 344. An inner shell 396 is defined by front wall panel 338, inner side wall panels 366 and 368, and bottom wall panel 344. Inner shell 396 forms a compartment that contains bundle 388. Bottom wall panel 344 is common to both outer and inner shells 394 and 396. Inner shell 396 is positioned in outer shell 394 in the assembled mode and is rotatable relative to outer shell 394 along forward bottom fold line 348, which is common to bottom wall panel 344 and front wall panel 338. Inner shell 396 is rotatably movable relative to outer shell 394 between a closed, or first, position wherein inner shell 396 is completely positioned within outer shell 394 and wherein bundle 388, which is held in inner shell 396, is inaccessible, and an open, or second, position wherein inner shell 396 is rotated partially out of the confines of outer shell 394 through the rectangular opening opposite rear wall panel 336 and wherein the entire contents of bundle 388 in the compartment of inner shell 396 is accessible.

FIG. 26 illustrates the result of the next step of placing a plastic wrap 398 about assembled dispensing package 392.

FIG. 27 illustrates inner shell 396 having been rotated from its first positioned described above into it second position by a consumer 398 so that bundle 388 with foil top 390 exposed. FIG. 28 illustrates consumer 398 having removed foil top 390 from bundle 388 so as to expose the entire array of cigarettes 399. Top wall panel 304 has a center opening 391 defined in part by side panels 330 so as to allow consumer 398 better access to bundle 388.

Because toggle snap-lock member 302A is connected by way of left and right lower snap-lock connecting flaps 320 and 322 to the outer surfaces of left and right inner side wall panels 366 and 368, which are part of inner shell 396, when inner shell 396 is pulled or pushed between its first and second positions, respectively, toggle snap-lock member 302A is also moved between first and second toggle locking positions, respectively Toggle snap-lock member 302A, in particular upper and lower snap-lock portions 306 and 308, 310, are in abutting relationship with the inner surface of rear wall panel 336 when inner shell 396 is in its first position; and upper and lower snap-lock portions 306 and 308, 310 are pulled away to a spaced relationship with rear wall panel 208 with fold line 314 spaced away from rear wall panel 336 when inner shell 396 is in its second position When inner shell 396 is in its first position, toggle snap-lock member 302A is in a first toggle on-center locking position that holds inner shell 396 in its first position, and when inner shell 396 is in its second position, toggle snap-lock member 302A is in a second toggle past-center locking position that holds inner shell 396 in its second position. Thus, toggle snap-lock member 302A prevents inner shell 396 from being accidentally moved from either from its first or second position.

FIG. 29 illustrates a full sectional view of assembled package 392 with inner shell 396 and toggle snap-lock member 302A in their first positions.

FIG. 30 illustrates a full sectional view of assembled package 392 analogous to the sectional view shown in FIG. 29 with inner shell 396 and toggle snap-lock member 302A in their second positions.

Figure 31:
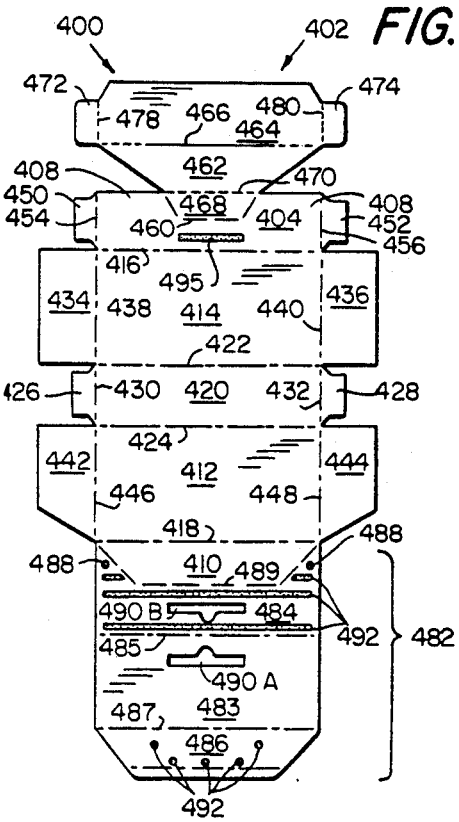
FIG. 31 is a plan view of a fourth embodiment of the present invention showing a plan view of a unitary starting blank for a wide-opening dispensing package that includes an extension member for hanging on a display rack.

A fourth embodiment of the inventive dispensing package designated generally by the numeral 400 is shown in the process of assembly in FIGS. 31–42 Dispensing package 400 is illustrated in its initial state in FIG. 31 as a unitary starting blank 402, which includes wall panel and connecting flaps described in terms such as top and bottom, upper and lower, and right and left in reference to the final assembled package illustrated in FIGS. 38–42. Starting blank 402 is shown with its inner surface facing upwardly in FIG. 31. A wide inner top wall panel 404 having a center opening 406 defined by a pair of opposed forwardly extending side portions 408 of top wall panel 404 (see FIG. 38) is connected to a wide rear wall panel 412 and a wide front wall panel 414 at parallel top fold lines 416 and 418, respectively, which are at the opposite top sides of rear wall panel 412 and front wall panel 414, respectively. A bottom wall panel 420 is connected to rear wall panel 412 and front wall panel 414 at parallel bottom fold lines 422 and 424, respectively, which are generally opposite from top fold lines 416 and 418, respectively. A right lower connecting flap 426 and a left lower connecting flap 428 are connected to opposite sides of bottom wall panel 420 at parallel fold lines 430 and 432, respectively, which are connected to and aligned transverse to fold lines 422 and 424. A narrow right outer side wall panel 434 and an opposite narrow left outer side wall panel 436 are connected to opposite sides of front wall panel wall panel 414 at parallel fold lines 438 and 440, respectively, which are +transverse to fold lines 416 and 422 and in general extension of fold lines 430 and 432, respectively. A narrow right inner side wall panel 442 and an opposite narrow left inner side wall panel 444 are connected to opposite sides of rear wall panel 412 at parallel fold lines 442 and 444, respectively, which are connected to and transverse to fold lines 418 and 424 and in general extension of fold lines 430 and 432, respectively. A right upper connecting flap 450 and a left upper connecting flap 452 are connected to opposite sides of inner top wall panel 404 at parallel fold lines 454 and 456, respectively, which are connected to and transverse to fold line 416 and in general extension of fold lines 438 and 440, respectively. Flaps 426 and 428 are slightly spaced from and freely movable relative to right and left outer and inner side wall panels 434, 436 and 442 and 44. Flaps 450 and 452 are slightly spaced from and freely movable relative to right and left outer side wall panels 450 and 452.

A toggle snap-lock member 458 is connected to the midarea of inner top wall panel 404 at a fold line 460, which is lateral to fold line 416. Snap-lock member 458 includes an upper snap-lock portion 462; a lower snap-lock portion 464 connected to upper snap-lock portion 462 at a fold line 466, which is lateral to fold line 460; a snap-lock upper connecting flap 468 connected to upper snap-lock portion 462 and to the mid area of inner top wall panel 404 at parallel fold lines 470 and 468, respectively, which are lateral to fold line 416; and a snap-lock right lower connecting flap 472 and a snap-lock right lower connecting flap 474 connected to opposite sides of snap-lock lower portion 464 at parallel fold lines 478 and 480, respectively, which are transverse to fold line 466. Upper connecting flap 468 extends between and is movable at fold line 460 relative to extending side portions 408 of top wall panel 404.

An extension member 482 for hanging disposal package 400 from a display rack is removably connected to vertical connecting panel 410. Extension member 482 includes a front panel 483 and a rear panel 484 connected to front panel 483 by a fold line 485 lateral to fold line 418; and a front top panel 486 connected to front panel 483 at a fold line 487 lateral to fold line 485. Rear panel 484 has a pair of opposed triangular-shaped side extensions 488 that fit into a pair of mating cutouts in vertical connecting panel 410. Rear panel 484 is removably connected to vertical connecting panel 410 along a perforated connector 489 which extends in its center portion lateral to fold line 418 and at its side portions at an angle along triangular side extensions 488. Front panel 483 forms a cutout 490 that is adapted to mate with a cutout 491 in rear panel 484 in the assembled mode as seen in FIG. 38.

Adhesives 492 positioned on top panel 484 of extension member 482 include a pair of laterally positioned adhesive strips extending across top panel 484 lateral to fold line 485 on either side of cutout 491, a pair of short adhesive strips positioned on triangular extensions 488, and include a pair of laterally positioned adhesive strips extending across top panel 484 lateral to fold line 485 on either side of cutout 491, a pair of short adhesive strips positioned on triangular extensions 488, and an adhesive spot on triangular extensions 488. Five adhesive spots 493 positioned in an arc across the inner surface of front panel 483 of extension member 482 are so positioned to become aligned with five circular, layered breakaway tabs 494 on the outer surface of inner top wall panel 404 (shown in FIG. 33) during the assembly process. In addition, an adhesive strip 495 is positioned across the center portion of top wall panel 404 lateral to fold line 416.

Figure 32:
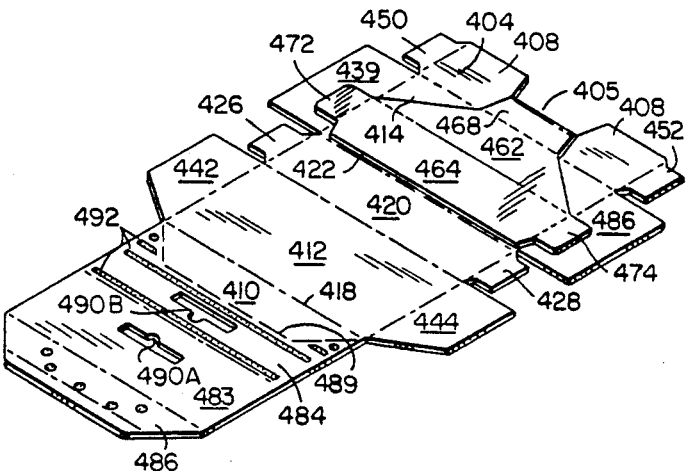
FIG. 32 is a perspective view of the blank shown in FIG. 31 after the first step of folding over the toggle snap-lock portion by a manufacturer.

After the steps of setting out starting blank 402 and placing adhesives 492 and 495, the manufacturer performs the next step as shown in FIG. 32, namely, folding over snap-lock member 458 along fold line 470 so that snap-lock member 458 is positioned upon the inner surface of inner top wall panel 404 and of rear wall panel front wall panel 414 with right and left lower connecting flaps positioned upon right and left outer side wall panels 434 and 436. Next, snap-lock upper connecting flap 468 is pressed against the inner surface of inner top wall panel 404 so that adhesive strip 495 adheres inner top wall panel 404 with snap-lock upper connecting flap 468.

Figure 33:
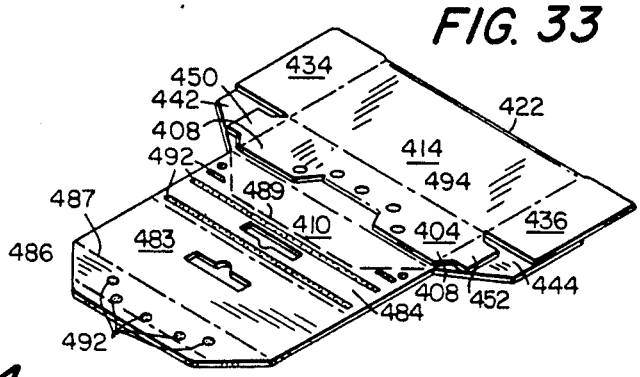
FIG. 33 is a perspective view of the blank shown in FIG. 32 after a second folding step.

The following step, shown in FIG. 33, is folding over front wall panel 414 together with right and left outer side wall panels 434 and 436 and left and right upper connecting flaps 450 and 452 along fold line 422 over rear wall panel 412, bottom wall panel 420, right and left inner side wall panels 442 and 444, and right and left lower connecting flaps 426 and 428.

Figure 34:
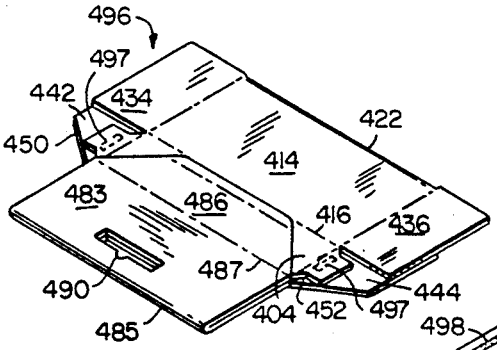
FIG. 34 is a perspective view of the package showing a third fold over into a final collapsed form of the package by the manufacturer after the second step of folding shown in FIG. 33.

The next step, shown in FIG. 34, is folding front panel 483 of extension member 482 along fold line 485 over front top panel 484 of extension member 482 and over vertical connecting panel 410 of the main package along with front top panel 486 of extension member 482 over the outer surface of inner top wall panel 404 so that the five adhesive spots 492 come into adhesive contact with the breakaway tabs 494. Adhesives 492 adhere rear panel 484 to front panel 483. Cutouts 490A and 490B come into alignment to complete a cutout hook 490 in extension member 482. This completes the manufacturer's assembly process into the final collapsed form 496.

Figure 35:
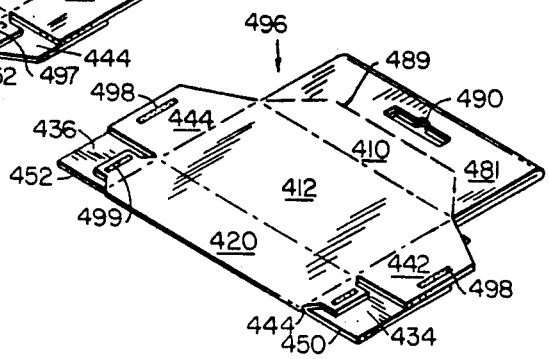
FIG. 35 is a perspective view of the reverse side of the final collapsed form of the package shown in FIG. 34.
Figure 43:
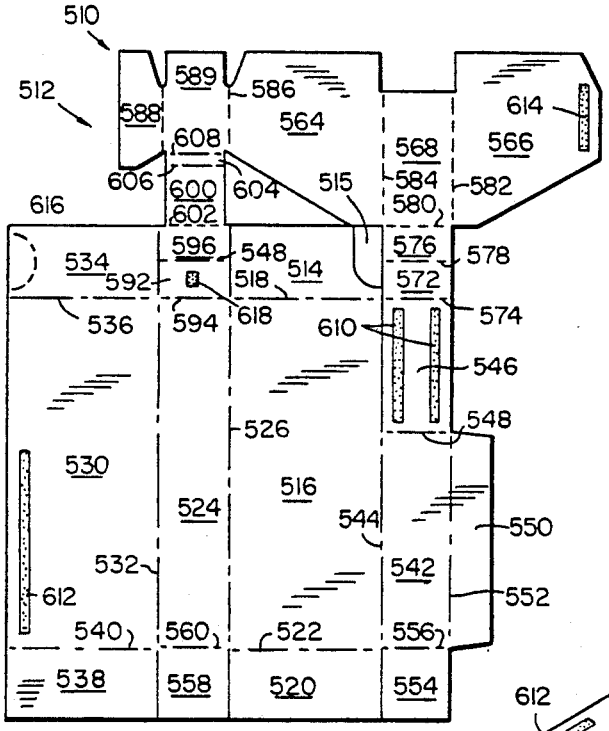
FIG. 43 is a plan view of a unitary starting blank of a fifth embodiment of the present invention.

FIG. 34 also illustrates in phantom line a pair of adhesive strips 497 on the outer surface of right and left upper connecting flaps 450 and 452 to be applied by the customer in the process of making the final package. FIG. 35, which is a perspective view of the reverse side of the final collapsed form 496 of the package shown in FIG. 34, also illustrates a pair of adhesive strips 498 positioned on the outer surfaces of right and left inner side wall panels 442 and 444 and a pair of adhesive strips 499 positioned on right and left lower connecting flaps 426 and 428 by the customer in the process of making the final package.

FIGS. 36, 37, and 38 illustrate the steps in the assembly of the package after the application of adhesive strips 497, 498, and 499 by the customer. FIG. 36 shows final collapsed form 496 having been moved to an erected position and flaps 426, 428; 450, 452; and 472, 474 of snap-lock member 458 having been folded outwardly in preparation for the insertion of a bundle 500 of a product comprising a bundle 500, or stack, of a plurality of separate, elongated items 501 to be sold, such as medical products, is slid into the empty compartment formed by the erected package through an open side defined by rear and front wall panels 412 and 414 and top and bottom wall panels 404 and 420. FIG. 37 illustrates the completion of the following steps performed by the customer, namely, the closing and the sealing of the package. In particular, the next step is the package being closed with flaps 426, 428; 450, 452; and 472, 474 being rotated from their prior outward positions to their final inward positions with flaps 450 and 452 being adhered to adhesives 498; and flaps 434 and 436 being adhered to adhesives 497 and 499. The final assembled package 502 is illustrated in an upright position in FIG. 38 ready for being hung from a display rack from cutout 490 at extension member 482.

Final assembled package 502 includes four upright wall panels including a wide rear wall panel 412 and an opposed wide front wall panel 414 and a pair of narrow right and left outer side wall panels 434 and 436, which are transverse to rear and front wall panels 412 and 414 and are connected to front wall panel 414. A bottom wall panel 420 is connected and transverse to rear and front wall panels 412 and 414 and to right and left outer side wall panels 434 and 436; and an inner top wall panel 404 opposed to bottom wall panel 420 is connected and transverse to right and left outer side wall panels 434 and 436 and rear wall panel 412. A vertical connecting panel 410 is connected to rear wall panel 412, and a pair of narrow right and left inner side wall panels 442 and 444 abutting right and left outer side wall panels 434 and 436 are connected to front wall panel 412 and bottom wall panel 420.

An outer shell 503 of assembled package 502 is defined by front wall panel 414, right and left outer side wall panels 434 and 436, inner top wall panel 414, and bottom wall panel 420. Outer shell 503 has a wide rectangular opening opposite rear wall panel 412, and which is substantially defined by the forward edges of inner top wall panel 404, outer side wall panels 434 and 436, and bottom wall panel 420. An inner shell 504 is defined by rear wall panel 412, right and left inner side wall panels 442 and 444, and bottom wall panel 420. Inner shell 504 forms a compartment that contains bundle 500. Bottom wall panel 420 is common to both outer and inner shells 503 and 504. Inner shell 504 is positioned within outer shell 503 when assembled package 502 is in a closed mode as seen in FIGS. 38 and 39. Inner shell 504 is rotatably movable relative to outer shell 503 at fold line 424 between the closed, or first, position wherein inner shell 504 is completely positioned within outer shell 503 and wherein bundle 500, which is basically held in inner shell 504, is inaccessible; and an open, or second, position wherein inner shell 504 is rotated partially out of the confines of outer shell 503 through the rectangular opening opposite rear wall panel 412 and wherein the entire contents of bundle 500 in the compartment of inner shell 504 is accessible.

FIG. 39 illustrates final assembled package 502 being disassembled by a consumer 505, who has torn extension member 482 from the main package along perforated connector 489 (not seen in FIG. 39) and simultaneously pulled layered breakaway tabs 494 from their adhesives 492 on inner top wall panel 404 leaving tab indents, or hollows, 494A. Center opening 406 allows consumer 505 better finger-gripping access to bundle 500.

FIG. 40 illustrates customer 505 pulling rear wall panel 414 and in particular inner shell 504 away from outer shell 503 by rotation along fold line 424, that is, inner shell 504 has been pulled from its first position to its second position so as to make the plurality of packets 501 fully accessible so that consumer 505 can select any of packets 501. When packets 501 are positioned in the compartment of inner shell 504, at least one entire packet 501 is accessible to being removed by consumer 505.

FIG. 41 illustrates consumer 505 removing a packet 501 from inner shell 504. FIG. 42 illustrates the consumer closing package 502 by first pressing vertical connecting panel 410 from its generally vertical position downwardly along top fold line 418 to a position lateral to inner top wall panel 404 and simultaneously inserting panel 410 under inner top wall panel 404. At the same time the consumer pushes inner shell 504 from its second position rotated away from outer shell 503 to its first position within outer shell 503.

Toggle snap-lock member 458 is connected byway of right and left lower snap-lock connecting flaps 472 and 474 to the outer surfaces of right and left inner side wall panels 442 and 444, which are part of inner shell 504. When inner shell 504 is moved between its first and second positions, toggle snap-lock member 458 is also moved between respective first and second toggle locking positions. Toggle snap-lock member 458, in particular upper and lower snap-lock portions 462 and 464, are in abutting relationship with the inner surface of rear wall panel 412 when inner shell 504 is in its first position; and upper and lower snap-lock portions 462 and 464 are pulled away to a spaced relationship with rear wall panel 412 with fold line 466 spaced away from rear wall panel 412 when inner shell 504 is in its second position. When inner shell 504 is in its first position, toggle snap-lock member 458 is in a first toggle on-center locking position that holds inner shell 504 in its first position; and when inner shell 504 is in its second position, toggle snap-lock member 458 is in a second toggle past-center locking position that holds inner shell 132 in its second position. Thus, toggle snap-lock member 458 prevents inner shell 504 from being accidentally moved from either from its first or second position.

A fifth embodiment of the inventive dispensing package designated generally by the numeral 510 is shown in the process of assembly in FIGS. 43–50A. Dispensing package 510 is illustrated in its initial state in FIG. 43 as a unitary starting blank 512, which includes wall panel and connecting flaps described in terms such as top and bottom, upper and lower, and right and left in reference to the final assembled package illustrated in FIGS. 47–50. Starting blank 512 is shown with its inner surface facing upwardly in FIG. 43. A wide outer top wall panel 514 having a cutout 515 is connected to a right side wall panel 516 at a fold line 518. Right side wall panel 516 is connected to an outer bottom wall panel 520 at a fold line 522 lateral to fold line 518 and is connected to a narrow rear wall panel 524 at a fold line 526 transverse to fold lines 518 and 522. A left side wall panel 530 is connected to rear wall panel 528 at a fold line 532 lateral to fold line 526. An inner top wall panel 534 is connected to left side wall panel 530 at a fold line 536 transverse to fold line 532. An inner bottom wall panel 538 is connected to left side wall panel 530 at a fold line lateral to fold line 536. A lower front wall panel 542 is connected to right side wall panel 516 at a fold line 544 lateral to fold line 526. An upper front wall panel 546 is connected to lower front wall panel 542 at a fold line 548 transverse to fold line 544. Upper front wall panel 546 and lower front wall panel 542 extend the height of right side wall panel 516 with upper front wall panel 546 unconnected to right side wall panel 516. A right side lower flap 550 is connected to lower front wall panel 542 at a fold line 552 lateral to fold line 544. A front bottom inner flap 554 is connected to lower front wall panel 552 by a fold line 556 lateral to fold line 548 and in extension of fold line 522. A rear inner flap 558 is connected to rear wall panel 524 at a fold line 560 in extension of fold line 522.

Starting blank 512 includes an inner shell which includes an inner right wall panel 564, an inner right wall panel 566, an inner upper front wall panel 568, and an inner rear wall panel 589.

An outer front securing flap 572 is connected to upper front wall 546 at a fold line 574 lateral to fold line 548. An inner front securing flap 576 is connected to outer front securing flap 572 at a fold line 578 lateral to fold line 574. Inner front securing flap 576 is also connected to inner upper front wall panel 568 at a fold line 580 lateral to fold line 578. Inner upper front wall panel 568 is connected to inner right wall panel 566 at a fold line 582 and is connected to inner right wall panel 564 at a fold line 584 lateral to fold line 582, with fold lines 582 and 584 being transverse to fold line 580. Inner rear wall panel 589 is connected to inner right wall panel 564 at a fold line 586 lateral to fold line 584. A right flap 588 is connected to inner rear wall panel 589 at a fold line 590 lateral to fold line 586.

A rear top flap 592 is connected to the top of rear wall 524 at a fold line 594 in general extension of fold lines 518 and 536; a rear bottom flap 596 is connected to rear top flap 592 at a fold line 598 lateral to fold line 594.

A toggle snap-lock member integrally connected to unitary blank 512 includes a top snap-lock, or toggle, wall panel 600 hingedly connected to inner bottom flap 596 at a hinge line 602 lateral to fold line 598; and a bottom snap-lock, or toggle, wall panel 604 hingedly connected to top snap-lock wall panel 600 at a hinge line 606 lateral to hinge line 602 and hingedly connected to top snap-lock wall panel 600 at a hinge line 606 parallel to hinge lines 602 and 608. As will be described, hinge lines 602, 606, and 608 are toggle hinges.

A pair of adhesive strips 610 on the inner surface of upper front wall panel 546 extend between and transverse to fold lines 548 and 574. An adhesive strip 612 is positioned on the inner surface of left side wall 530 along the open side opposite fold line 532 generally between fold lines 536 and 540. An adhesive strip 614 is positioned on the surface of inner right wall panel 566 at an area opposite to and lateral to fold line 582. A semicircular separable, or breakaway, tab 616 is integral with inner top wall 534 with the straight side integral with the side wall of inner top wall 534 transverse to fold line 536 and generally opposite the freely movable side of inner top wall in general alignment with fold line 532. An optional adhesive spot 618 can be positioned on rear top snap-lock hinge flap 592.

Figure 44:
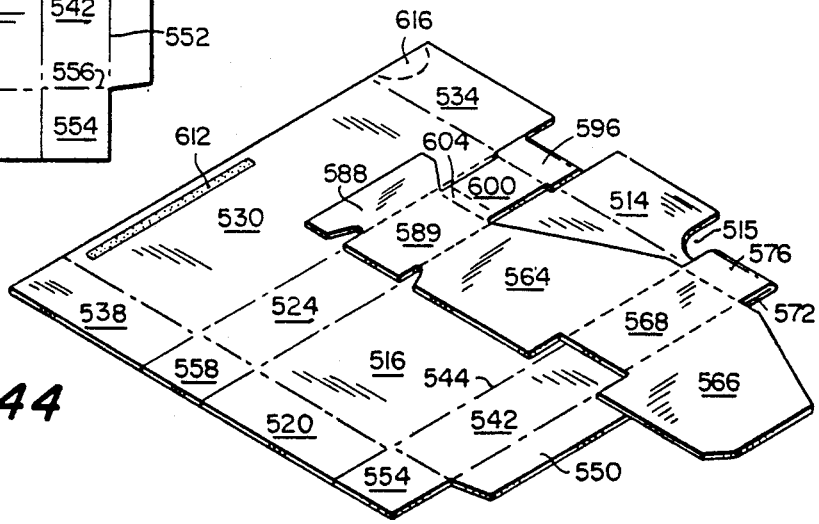
FIG. 44 is a perspective view of the blank shown in FIG. 43 after a first step of folding over a portion of the blank and securing an adhesive area in assembling an erected package by a manufacturer or a customer.

After the steps of setting out starting blank 512 and placing adhesives 610, 612, and 614, the manufacturer performs the next step as shown in FIG. 44, namely, folding over the inner shell panels along with the snap-lock panels along fold lines 598 and 578 so that the inner shell panels and the snap-lock panels are positioned upon the inner surface of the remainder of the blank so that inner right wall panel 564 in particular is positioned on right side wall panel 516, inner upper front wall panel 568 adheres to upper front wall panel 546 by way of adhesive strips 610, inner rear wall panel 589 lies upon rear wall 524, rear top snap-lock hinge 596 is in contact with rear bottom snap-lock hinge 592, and inner front flap 576 lies upon outer front flap 572. Rear bottom snap-lock hinge flap 596 adheres to rear top snap-lock hinge flap 592 if optional adhesive spot 618 has been applied.

Figure 45:
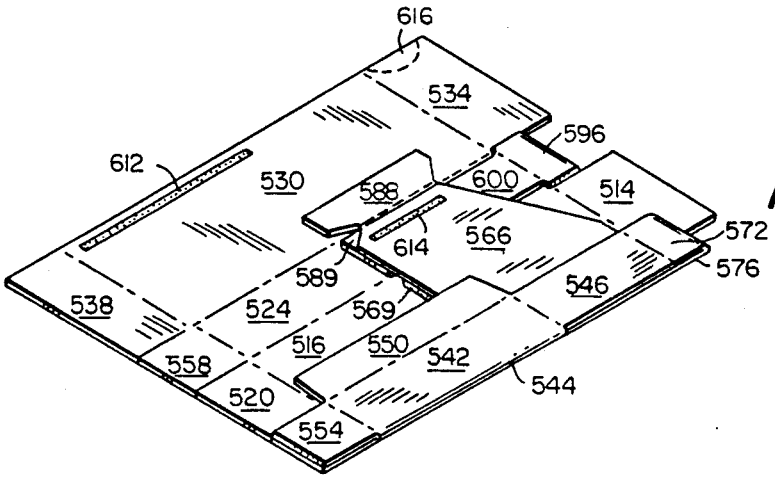
FIG. 45 is a perspective view of the blank shown in FIG. 44 after a second step of folding over another portion of the blank.

The following step, shown in FIG. 45, is folding over lower front wall panel 542 along with upper front wall panel 546, inner upper front wall panel 568, right side wall panel 566, flap 550, securing flaps 572/576, and front bottom inner flap 554 over the remaining portions of the unitary blank along fold line 544.

Figure 46:
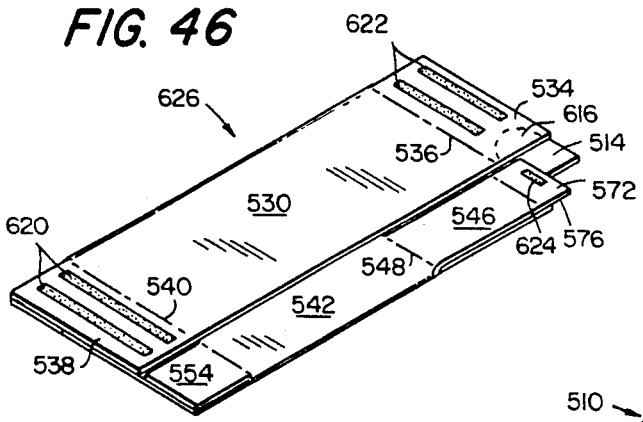
FIG. 46 is a perspective view of the partially assembled dispensing package illustrated in FIG. 45 after a third step of folding over another portion of the blank and securing adhesive areas.

The next step, shown in FIG. 46, is folding left side wall 530 with inner top wall 534 and inner bottom wall 548 along fold line 532 upon the blank thus folding left flap 588 along fold line 590 onto inner right wall panel 566 and into contact with adhesive strip 614. Left flap 588 is then pressed into adherence with inner right wall panel 566. Left side wall 530 is pressed into adhesive contact with lower right flap 550 by way of adhesive strip 612. This completes the manufacturer's assembly process into the final collapsed form 626.

FIG. 46 also illustrates a pair of adhesive strips 620 positioned on inner bottom wall 538 and a pair of adhesive strips 622 positioned on the surface of inner top wall 534. Strips 620 are lateral to fold line 540; and strips 622 are lateral to fold line 536. Strips 620 and 622 are added by the customer before the step of erection illustrated in FIG. 47. An adhesive spot 624 is optionally placed upon the surface of outer front flap 572. FIG. 46 illustrates a final collapsed form 626 of the disposal package.

Figure 47:
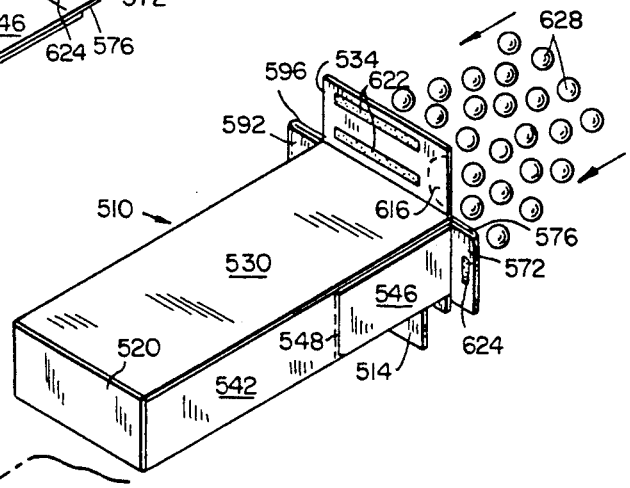
FIG. 47 is a perspective view of the assembled and erected package illustrated in FIG. 46 being filled with particulates.

FIG. 47 illustrates the final steps in the assembly of the package by the customer after the application of adhesive strips. FIG. 47 shows final collapsed form 626 having been moved to erected disposal package 510. Front and rear bottom flaps 554 and 558 are folded inwardly and inner bottom wall 538 is folded inwardly and inner bottom wall 538 is then folded inwardly over flaps 554 and 556 with outer bottom wall 520 folded over and affixed to inner bottom wall 520 at adhesive strips 620. Flaps 514, 534, 572/576, and 592/596 are folded outwardly in preparation for the insertion of a particulate product to be sold, such as loose candy pieces 628, which are poured or slid into the empty compartment formed by the erected package through an open side defined by front upper wall and rear wall 546 and 524 and side wall panels 516 and 530.

The completion of the following steps are performed by the customer, namely, the closing and the sealing of the package. In particular, the next step is closing the package by folding flaps 572/576 and 592/596 and outer top wall 514, which adheres to bottom top wall 534 at adhesive strips 622. Semicircular tab 616 is exposed through cutout 515.

Final assembled package 510 includes an outer shell 634 and an inner shell, which is movable within outer shell 634. Outer shell 634 includes four upright wall panels including a narrow rear wall panel 524, an opposed narrow front wall panel, which comprises lower front wall panel 542, a pair of wide right and left outer side wall panels 516 and 530, which are transverse to rear and front wall panels 524 and 542 and are connected to rear wall panel 524; an outer bottom wall panel 520 which is connected and transverse to right side wall panel 516; and an outer top wall panel 514 opposed to bottom wall panel 520 which is connected and transverse to right side wall panel 516. The inner shell, which is slidably movable within outer shell 634, includes left and right side panels 589 and 566, upper front wall panel 546, inner rear wall panel 589, and inner and outer upper front wall panels 546 and 568.

Figure 48:
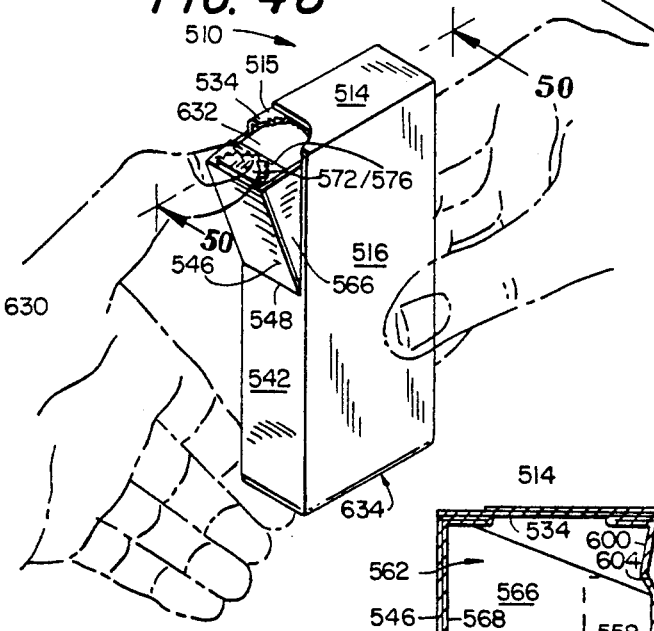
FIG. 48 is a perspective view of the erected package illustrated in FIG. 47 being opened by a consumer.

The final assembled package 510 is illustrated in an upright position in FIG. 48 being opened by the thumb of a consumer 630 after the pressing out of semicircular tab 616 leaving flap 572/576 exposed so that upper front wall panel 546 is rotated outwardly at fold line 548 so as to pull the inner shell into an active mode to be discussed below. A opening 632 to the inner compartment of dispenser package 510 is created so as to free particulates 628 for pouring by tilting package 510.

Figure 50A:
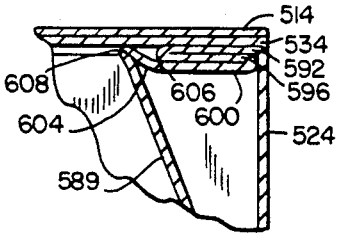
FIG. 50A is detail enlargement of the snap-lock mechanism illustrated in FIG. 50.
Figure 50:
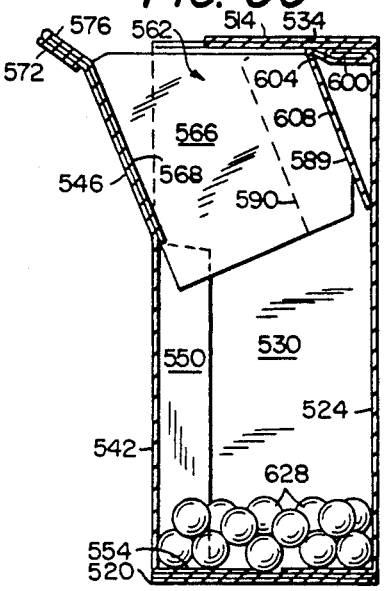
FIG. 50 is a cross-sectional view analogous to the view illustrated in FIG. 49 with the package closed.
Figure 49:
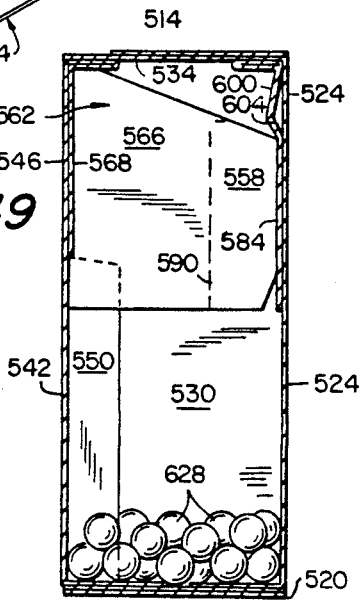
FIG. 49 is a cross-sectional view taken through plane 50—50 in FIG. 48.
Figure 49A:
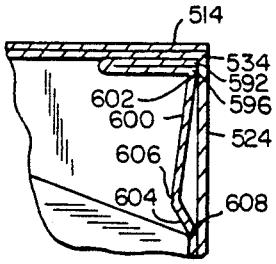
FIG. 49A is a detail enlargement of the snap-lock mechanism illustrated in FIG. 49 with the package closed.
Figure 51:
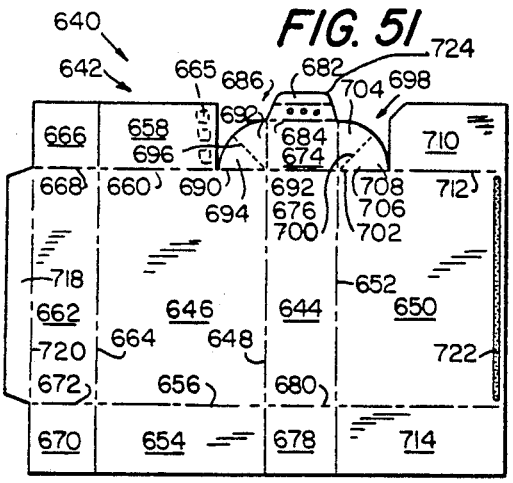
FIG. 51 is a plan view of a unitary starting blank of a sixth embodiment of the present invention.

The inner shell is moved between first and second positions as dispenser package 510 is moved respectively between its closed mode as illustrated in FIG. 49 and its open mode as illustrated in FIG. 50. Inner left and right side wall panels 564 and 566 are in abutting relationship with the inner surfaces of left and right side wall panels 516 and 530 of outer shell 634 and slide along side wall panels 516 and 530 as the inner shell is moved between its first and second, or open and closed, respectively, positions. As illustrated best in enlarged detail in FIG. 49A relating to FIG. 49 in the closed mode of dispensing package 510 and the first position of the inner shell, rear top and bottom toggle snap-lock hinge flaps 592 and 596 are in abutting relationship with inner top wall panel 534; and top toggle panel 600 and bottom toggle panel 604 are angled at fold line 606 spaced from rear wall panel 524 in adjoining relationship with rear wall panel 524 while inner rear wall panel 589 is in abutting relationship with rear wall panel 524. As illustrated best in enlarged detail in FIG. 50A relating to FIG. 50 in the closed mode of dispenser package 510 and the second position of the inner shell, rear top and bottom snap-lock hinge flaps 592 and 596 remain in abutting relationship with inner top wall panel 534 while top toggle wall panel 600 and bottom toggle wall panel 604 are rotated away from their generally adjoining relationship with rear wall panel 524 to a generally lateral adjoining relationship with inner top wall panel 534 while inner rear wall panel 589 is pulled away from rear wall panel 524 with the lower end of inner rear wall panel 589 in pressing relationship with rear wall 524.

In the first position, toggle wall panel 604 and inner rear wall panel 589 are toggled about fold lines 606 and 608 so as form a first locking toggle that locks the toggle snap-lock member and the inner shell in its first position and thus holds dispensing package 510 in its closed mode. In the second position, toggle lever wall 604 and rear snap-lock wall 589 are toggled about fold lines 606 and 608 in an opposite position from the first position so as to hold dispensing package in its open mode.

A sixth embodiment of the inventive dispensing package designated generally by the numeral 640 is shown in the process of assembly in FIGS. 51-60. Dispensing package 640 is illustrated in its initial state in FIG. 51 as a unitary starting blank 642, which includes wall and connecting flaps described in such terms as top and bottom and right and left in reference to the final assembled package illustrated in FIGS. 58-60. Starting blank 642 is shown with its inner surface facing upwardly in FIG. 51. A narrow front wall 644 is connected to a right side panel 646 at a fold line 648 and is also connected to a left side panel 650 at a fold line 652 lateral to fold line 648. Right side panel 646 is connected to an outer bottom wall 654 at a fold line 656 transverse to fold line 648; is also connected to an outer rear top wall 658 at a fold line 660 transverse to fold line 648; is also connected to a rear wall 662 at a fold line 664 transverse to fold lines 656 and 660. Rear wall 662 is connected to a rear inner top flap 666 at a fold line 668 transverse to fold line 664; and is further connected to a rear inner bottom flap 670 at a fold line 672 transverse to fold line 664. Three circular breakaway tabs 665 shown in dashed line are located on the opposite surface of outer rear top wall 658 in a line transverse to fold line 660 and adjacent to right gusset 682. Front wall 644 is connected to a front top wall 674 at a fold line 676 transverse to fold line 648; and is also connected to a front inner bottom flap 678 at a fold line 680 transverse to fold line 648. Front top wall 674 is connected to a sealing flap 682 at a fold line 684 lateral to fold line 676. A quadricircular right gusset 686 is connected to front top wall 674 at a fold line 688 that is a continuation of fold line 648 and is also connected to right side panel 646 at a fold line 690 that is a continuation of fold line 660. Right gusset 686 includes a top gusset portion 692 connected to a bottom gusset portion 694 at a fold line 696. A quadricircular left gusset 698 is connected to front top wall 674 at a fold line 700 that is a continuation of fold line 652 and is also connected to left side panel 650 at a fold line 702 that is a continuation of fold line 676. Left gusset 698 includes a top gusset portion 704 connected to a bottom gusset portion 706 at a fold line 708. An inner rear top wall 710 is connected to left side panel 650 at a fold line 712 that is a continuation of fold line 702. An inner bottom wall 714 is connected to left side panel 650 at a fold line 716 that is a continuation of fold line 680. A rear sealing flap 718 is connected to rear wall 662 along a fold line 720 that is transverse to fold lines 656 and 660 and opposite and lateral to fold line 664. An adhesive strip 722 is positioned along the outside edge of left side panel 650 opposite fold line 652. Three adhesive spots 724 are positioned on the inner surface of sealing flap 682.

Figure 52:
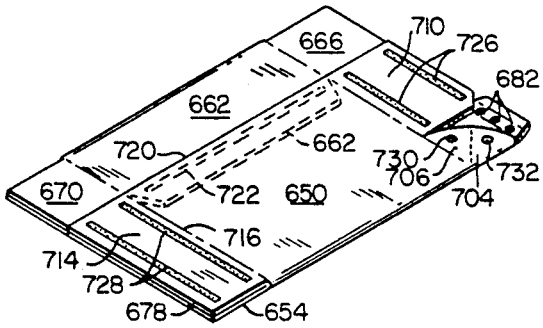
FIG. 52 is a perspective view of the blank shown in FIG. 51 after a first step of folding over a portion of the blank and securing an adhesive area in assembling an erected package by a manufacturer or a customer.
Figure 57:
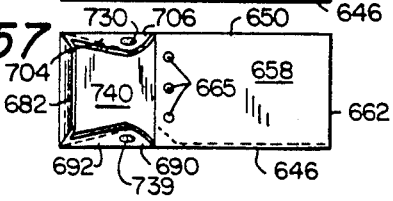
FIG. 57 is a top view of the package illustrated in FIG. 56 after being opened.
Figure 58:
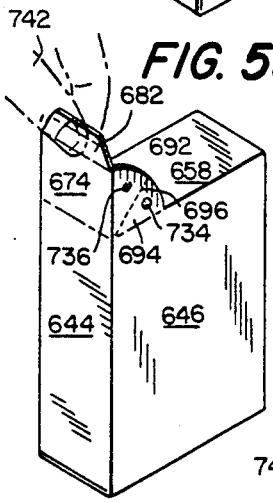
FIG. 58 is a perspective view of the opened package illustrated in FIG. 57.

After the steps of setting out starting blank 642 and placing adhesives 722 and 724, the customer performs the next step as shown in FIG. 52, namely, folding over rear wall 662 with rear sealing flap 718 onto right side panel 646 along with rear inner top and bottom flaps 666 and 670 onto outer rear top and bottom wall panels 658 and 654, respectively. The following step, also illustrated in FIG. 52 is folding over left side panel 650 over right side panel 646 so that adhesive strip 722 is positioned onto and placed into adhering relationship with rear sealing flap 718. Inner rear top and bottom wall panels 710 and 714 are rotated at this time into relationship with upper and lower portions of starting blank 642. The customer also places a pair of adhesive strips 726 lateral to fold line 712 on the upper surface of inner rear top wall 710; and further places a pair of lateral adhesive strips 728 lateral to fold line 716 on the upper lower surface of inner bottom wall 714. A circular breakaway tab 730 is located on the upper surface of left bottom gusset portion 706, and an adhesive spot 732 is placed on left top gusset portion. As illustrated in FIGS. 57 and 58, a circular breakaway tab 734 is located on the upper surface of right bottom gusset portion 694, and an adhesive spot 736 is located on the top right gusset portion 692.

Figure 53:
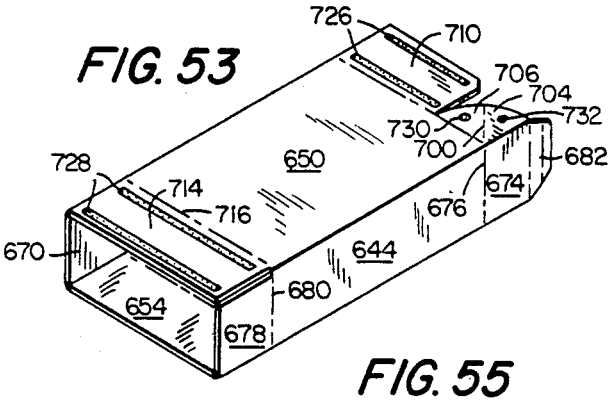
FIG. 53 is a perspective view of the blank shown in FIG. 52 after a step of erecting the blank.

The following step, illustrated in FIG. 53, is erecting blank 642.

Figure 54:
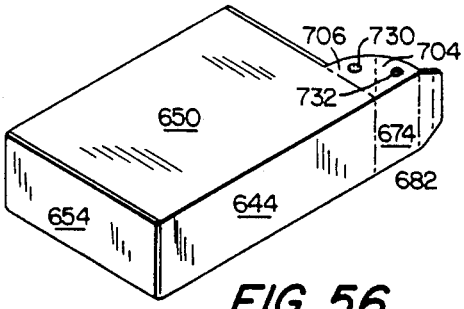
FIG. 54 is a perspective view of the erected dispensing package illustrated in FIG. 543 after a step of folding over another portion of the blank and securing adhesive areas.

The following steps, illustrated as completed in FIG. 54, include folding rear inner top flap 666 downwardly, folding inner rear top wall 710 downwardly over inner top flap 666, and then folding outer rear top wall 658 over inner rear top wall 710 and finally adhering outer and inner rear top wall panels 658 and 710 together at adhesive strips 726. Also shown as being completed in FIG. 54 are the steps of folding inner rear and front bottom flaps 670 and 678 inwardly, folding inner bottom wall 714 over flaps 670 and 678, and folding outer bottom wall 654 over inner bottom wall 714 and finally adhering outer and inner bottom wall panels 654 and 714 together at adhesive strips 728.

Figure 55:
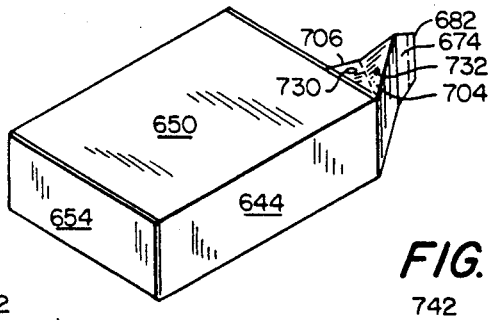
FIG. 55 is a perspective view of the partially assembled and erected package illustrated in FIG. 54 during the final folding step.
Figure 56:
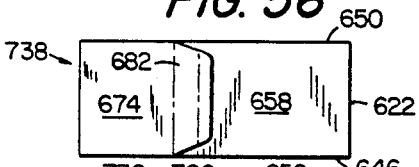
FIG. 56 is a top view of the erected and filled package illustrated in FIG. 55.

FIG. 55 illustrates front top wall 674 and sealing flap 682 being folded downwardly with right and left gussets 686 and 698 being at the same time folded between their fold lines 696 and 708 just prior to their being flattened when front top wall 674 is laid flat in alignment with outer rear top wall 658 and with sealing flap 682 lying flat upon outer rear top wall 658 as illustrated in FIG. 56. Sealing flap is adhesively secured to rear top wall 658 by adhesive spots 724, which are in adhesive contact with circular breakaway tabs 665. The steps shown in FIG. 56 include right and left gussets 686 and 698 each being folded inwardly along their fold lines 694 and 798 so that the top and bottom gusset portions of each are adhered together by adhesive spots 732 and 736 at circular breakaway tabs 730 and 734, respectively. This completes the customer's assembly process into the final erected dispensing package 738.

The filling of dispensing package 738, which is not illustrated, occurs between the steps occurring between FIGS. 53 and 54. An inner liner or bag 9 (not shown) can be inserted into the compartment at this time followed by the actual filling of the compartment with a large particulate product such as soap flakes, macaroni, or cereals. The liner or bar is then sealed. An adhesive can be placed on either the liner or on the underside of right and left bottom gusset portions 694 and 706 so that the named surfaces adhere to one another in the final sealing process.

FIGS. 57 and 58 illustrates the hand of a consumer 742 raising sealing flap 682 so as to tear flap 682 from its sealing relationship with outer top wall 658 and lifting front top wall 674 upwards so as to create an opening 740 to the compartment of dispensing package 738. The tops of breakaway tabs 665 adhere to adhesive spots 724 and are torn from the top of outer rear top wall 658. The liner or bag, if any, that might be present would be opened by the pulling upwards of right and left gussets 686 and 698 from adherence with the top of the liner or bag so as to tear the top of the liner or bag open.

Figure 59:
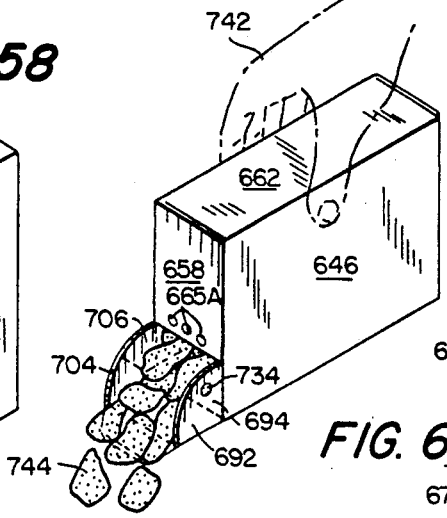
FIG. 59 is a perspective view of the opened package illustrated in FIG. 58.

FIG. 59 illustrates consumer 742 tilting dispensing package 738 so as to pour out particulates 744 from the package through opening 740.

Figure 60:
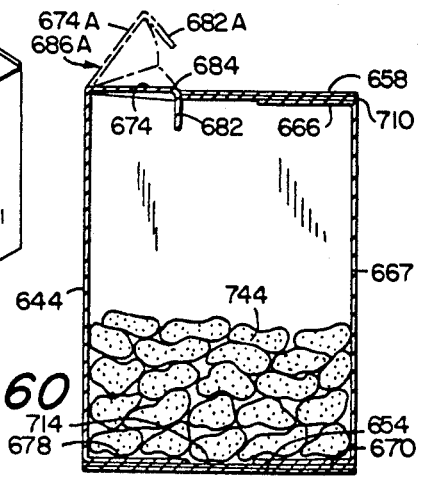
FIG. 60 is a cross-sectional view of the package shown in FIG. 58 in a closed position.

FIG. 60 illustrates sealing flap 682 folded along fold line 684 and tucked into the edge of opening 740 adjacent to outer rear top wall 658 so that front top wall 674 is held firmly over opening 740. The intermediate closing position is shown in phantom line as front top wall 674A, sealing flap 682A, and right gusset 686A.

Final assembled package 738 includes four upright walls including a narrow rear wall 662 and an opposed narrow front wall 644 and a pair of wide right and left outer side panels 646 and 650, which are transverse to rear and front wall panels 662 and 644. An outer bottom wall 654 is connected and transverse to right side panel 646; and an outer rear top wall 658 and an outer front top wall 710 opposed to bottom wall 654 are connected and transverse to right side panel 646 and to left side panel 650, respectively.

The present invention will be better understood and the objects and important features, other than those specifically enumerated above, will become apparent when consideration is given to the following details and descriptions, which when taken in conjunction with the annexed drawings, describes, discloses, illustrates, and shows preferred embodiments of the present invention and what is presently considered to be the best mode of practice in the principle thereof. Other embodiments or modifications may be suggested to those having the benefit of the teachings herein. Such other embodiments or modifications are intended to be reserved especially as they fall within the scope and spirit of the subjoined claims.

What is claimed is:

1. A multiple-purpose dispensing package comprising an outer shell having a multi-edged bottom surface and a plurality of panels including side walls panels upstanding therefrom the number of side wall panels being at least one less than the number of edges of said bottom surface such that said outer shell includes an elongated opening therein; one of said side wall panels constituting an outer shell rear wall panel oppositely disposed with respect to said elongated opening, an inner shell including inner shell front and side wall panels, said inner shell front wall panel being integral with and pivotably connected to said outer shell along said bottom surface at said elongated opening, said inner shell being movable along said bottom surface and said inner shell front wall panel between a first position within said outer shell in which the interior of said inner shell is inaccessible and a second position partially out of the confines of said outer shell in which the interior of said inner shell is accessible, and snap-lock means joining said inner shell with said outer shell for firmly seating said inner shell in either of said first and second positions, and for precluding said inner shell from being withdrawn completely out of the confines of said outer shell, said snap-lock means having upper and lower snap-lock portions connected at a fold line, and having at least one pair of connecting flaps connected to one of said snap-lock portions, and said snap-lock means further maintaining said inner shell rigid and precluding said inner shell from moving from either of its two positions accidentally.

2. The package according to claim 1, wherein said outer shell rear wall panel, and said inner shell front wall panel are broader than said side wall panels other than said inner shell front wall panel, wherein when said inner shell is in its second position, the entire contents of the package are disclosed.

3. The package according to claim 1, wherein said snap-lock means joins one of said inner shell wall panels with said rear outer shell wall panel.

4. The package according to claim 1, wherein said inner and outer shells are integrally fabricated from a unitary blank and a snap-lock blank which is secured to said inner shell after positioning the contents of the package upon said inner shell front wall panel.

5. The package according to claim 1, wherein said inner and outer shells and said snap-lock means are integrally fabricated from a unitary blank.

6. The package according to claim 5, wherein said inner and outer shells and said snap-lock means are folded and adhesively secured into a collapsed preglued form which can then be subsequently erected into the final package form, filled, and then sealed.

7. The package according to claim 1, further including panel means connected to said inner shell for hanging said package form a display rack.

8. A multiple-purpose dispensing package comprising an outer shell having opposed multi-edged bottom and top wall panels and a plurality of panels including side wall panels upstanding therebetween, one of said side wall panels including an outer shell front wall panel and an outer shell rear wall panel, said top wall panel having a top opening associated with said outer shell front wall panel, an inner shell including inner shell front and side wall panels, said inner shell front wall panel being pivotably connected to said outer shell front wall panel along a pivot line, said inner shell being movable between a first position within said outer shell in which the interior of said inner shell is inaccessible and a second position partially out of the confines of said outer shell in which the interior of said inner shell is accessible through said top opening, and snap-lock means joining said inner shell with said outer shell rear wall panel for firmly seating said inner shell in either of said first and second positions, and for precluding said inner shell from being withdrawn completely out of the confines of said outer shell, said snap-lock means having upper and lower snap-lock portions connected at a fold line, and having at least one pair of connecting flaps connected to one of said snap-lock portions; and said snap-lock means further maintaining said inner shell rigid and precluding said inner shell from moving from either of its two positions accidentally.

9. The package according to claim 8, wherein said snap-lock means joins one of said inner shell wall panels with said rear outer shell wall panel.

10. The package according to claim 8, wherein said inner and outer shells and said snap-lock means are integrally fabricated from a unitary blank.

* * * * *